US007118489B1

(12) United States Patent
Hubley

(10) Patent No.: US 7,118,489 B1
(45) Date of Patent: Oct. 10, 2006

(54) GOLF SWING TRAINING DEVICE

(76) Inventor: Bruce Hubley, 163 Starlite Dr., San Mateo, CA (US) 94402

( * ) Notice: Subject to any disclaimer, the term of this patent is extended or adjusted under 35 U.S.C. 154(b) by 84 days.

(21) Appl. No.: 11/004,450

(22) Filed: Dec. 4, 2004

(51) Int. Cl.
*A63B 69/36* (2006.01)

(52) U.S. Cl. ..... 473/226; 473/219; 473/235

(58) Field of Classification Search ..... 473/286, 473/207–273, 279; 273/DIG. 4, DIG. 30
See application file for complete search history.

(56) References Cited

U.S. PATENT DOCUMENTS

| | | | | | |
|---|---|---|---|---|---|
| 1,585,446 | A | * | 5/1926 | Warwick | 124/5 |
| 1,674,294 | A | * | 6/1928 | O'Rourke | 294/19.2 |
| 2,057,821 | A | | 10/1936 | Costello | |
| 2,094,766 | A | | 10/1937 | Costello | |
| 2,621,044 | A | | 12/1952 | Sloan | |
| 3,058,767 | A | * | 10/1962 | Baker | 294/19.2 |
| 3,126,206 | A | | 3/1964 | Sabia | |
| 3,194,564 | A | | 7/1965 | Swan | |
| 3,749,407 | A | * | 7/1973 | Prochnow | 473/286 |
| 4,139,198 | A | | 2/1979 | Kanavas | |
| D256,262 | S | * | 8/1980 | Benson | D21/745 |
| 4,762,324 | A | * | 8/1988 | Anderson | 473/249 |
| 4,877,251 | A | | 10/1989 | Faust | |
| 4,962,927 | A | | 10/1990 | Colucci | |
| 5,011,153 | A | | 4/1991 | Watkins | |
| 5,090,698 | A | * | 2/1992 | Kleinfelter | 473/313 |
| 5,351,962 | A | | 10/1994 | Lin | |
| 6,325,350 | B1 | * | 12/2001 | Mancuso | 248/311.2 |
| 6,425,562 | B1 | * | 7/2002 | Knudson | 248/230.1 |
| 6,464,596 | B1 | | 10/2002 | Belding | |
| 6,669,583 | B1 | * | 12/2003 | Deppen | 473/474 |
| 6,752,724 | B1 | * | 6/2004 | Schumacher | 473/266 |

FOREIGN PATENT DOCUMENTS

| | | |
|---|---|---|
| CA | 2.116.891 | 5/1994 |
| GB | 1.236 982 | 6/1971 |

* cited by examiner

*Primary Examiner*—Nini F. Legesse
(74) *Attorney, Agent, or Firm*—Michael I. Kroll

(57) ABSTRACT

Apparatus 10 for a golf swing training device comprising a golf club 20 with a shaft 24 with a grip 22 at one end and a club head 26 at the other end of the shaft with a cup 12 attached to the face 14 of the club head with the cup opening on the front towards the intended target. The bore of the cup 12 conforms substantially to the diameter of the ball 28. In use, a ball 28 is placed in the cup 12 with the intention of releasing the ball from the cup at a desired point during the swing at a target. In practice, if during the back swing the cup 12 is incorrectly tilted, due to poor swing mechanics, the ball 28 will fall out. Also, if the bore of the cup 12 is not in alignment with the target line at the ball's 28 point of release the ball trajectory will be skewed from the target. As an additional element, the cup 12 can have a circumferential ridge 40 on the interior to impede the ball 28 from easily falling out and the cup can be removably attached at 36, 38 to the club face 14.

8 Claims, 32 Drawing Sheets

GOLF SWING TRAINING DEVICE

BACKGROUND OF THE INVENTION

1. Field of the Invention

The present invention provides a golf swing training device comprising a shaft with a grip at one end and a club head at the other end of the shaft with a cup attached to the face of said club head with the cup opening on the front towards the intended target. The bore of the cup conforms substantially to the diameter of the ball. In use, a ball is placed in the cup with the intention of releasing the ball from the cup at a desired point during the swing at a target.

In practice, if during the back swing the cup is incorrectly tilted, due to poor swing mechanics, the ball will fall out. Also, if the bore of the cup is not in alignment with the target line at the ball's point of release the ball trajectory will be skewed from the target.

The present invention provides a golf swing training device that helps the golfer develop a back swing along the correct swing plane, at a slow pace, while rotating the hands properly thus keeping the ball from falling out of the cup.

The present invention provides a golf swing training device that promotes the correct extension and rotation of the hands along the target line, during the down swing, leading to a proper finish.

If the down swing is done correctly the ball will leave the cup at the bottom of the swing and fly directly down the target line in a manner that is predictable and repeatable. Any swing other than a correct swing will cause the ball to go left, right, lower or higher of the target line.

As an additional element the cup can have a circumferential ridge on the interior to impede the ball from easily falling out and the cup can be removably attached to the club head.

2. Description of the Prior Art

There are other golf club devices designed for training. Typical of these is U.S. Pat. No. 2,057,821 issued to Costello on Oct. 20, 1936.

Another patent was issued to Costello on Oct. 5, 1937 as U.S. Pat. No. 2,094,766. Yet another U.S. Pat. No. 2,621,044 was issued to Sloan on Dec. 9, 1952 and still yet another was issued on Mar. 24, 1964 to Sabia as U.S. Pat. No. 3,126,206.

Another patent was issued to Swan on Jul. 13, 1965 as U.S. Pat. No. 3,194,564. Yet another U.S. Pat. No. 4,139,198 was issued to Kanavas on Feb. 13, 1979. Another was issued to Faust on Oct. 31, 1989 as U.S. Pat. No. 4,877,251 and still yet another was issued on Oct. 16, 1990 to Colucci as U.S. Pat. No. 4,962,927.

Another patent was issued to Watkins on Apr. 30, 1991 as U.S. Pat. No. 5,011,153. Yet another U.S. Pat. No. 5,351,962 was issued to Lin on Oct. 4, 1994. Still yet another patent was issued on Oct. 15, 2002 to Belding as U.S. Pat. No. 6,464,594. Another was issued to Jenkinson on Jun. 23, 1971 as U.K. Patent No. GB1236982 and still yet another was issued on Sep. 5, 1994 to Iriarte, et al. as Canadian Patent No. CA 2,116,891.

U.S. Pat. No. 2,057,821

Inventor: Henry O. Costello

Issued: Oct. 20, 1936

In a practice golf club comprising a shank portion and a head portion, separate sets of projecting members extending outwardly from that part of the head portion which corresponds with the striking face of an ordinary golf club and spaced from each other a distance materially less than the diameter of a practice golf ball to compressibly receive therebetween a practice golf ball when struck at such an angle as to force an entry within the space defined by said opposed sets of projecting members, said members being each provided with rounded end and edge portions adapted to guide a practice golf ball within the space defined by the opposed sets of projecting members or deflect the same therefrom without injury to the ball.

U.S. Pat. No. 2,094,766

Inventor: Henry O. Costello

Issued: Oct. 5, 1937

The combination with a golf club comprising a head and a shaft secured to the head, a practice ball, a resiliently gripping holding member fitting over' and detachably secured to the club shaft adjacent to the free end thereof, and means connecting said' detachable holding member and' practice' ball for limiting the extent of, movement of said ball when struck by said golf club.

U.S. Pat. No. 2,621,044

Inventor: Joseph P. Sloan

Issued: Dec. 9, 1952

A golf practice device for conventional golf clubs, consisting of an auxiliary head generally U-shaped in cross section with abridge member and depending parallel blades with continuous ground engaging bottom edges forming an open elongated groove along the under face of said head of sufficient width and height to clear an object of substantially the same diameter as a conventional golf ball when the latter is in normal playing position relative, to the ground, and means on said bridge member affording detachable interfitting engagement with the head of a conventional golf club.

U.S. Pat. No. 3,126,206

Inventor: Daniel Joseph Sabia

Issued: Mar. 24, 1964

A golf club adapted to indicate the quality of a practice swing comprising; in combination; a shaft; a club head; said club head including a substantially planar face surface, a body which extends rearwardly therefrom to an arcuate rear surface, a top surface, and a substantially planar bottom surface positioned with respect to said shaft for striking engagement with the ground during said practice swing; and means for coupling said shaft to said club head such that the axis of said shaft both lies in a plane substantially parallel to the plane of said face surface and is angular to the plane of said bottom surface; said club head integrally including a depression in said top surface thereof in the form of a straight, hollow, open-ended channel commencing at said face surface and extending rearwardly therefrom through said rear surface; said depression descending downward from said top surface toward said bottom surface such that the depth of said channel is substantially coextensive with the vertical dimension of said club head, and only a thin bridge exists between the bottom of said channel and said bottom surface; the width of said channel throughout its entire length being of sufficient dimension to admit passage of a golf ball therethrough.

U.S. Pat. No. 3,194,564

Inventor: Lawrence S. Swan

Issued: Jul. 13, 1965

A practice golf club comprising: a club head having a substantially flat golf ball striking face in which a pair of apertures, substantially perpendicular to said face and spaced apart a distance greater than the diameter of a golf bail, are provided to define that portion of said face, which is the desired impact area and a pair of pins spring held in respective ones of said apertures for releasable insertion and each having a length which is at least a substantial portion of the diameter of a golf ball such that one or the other of said pins engages the golf all if the complete swing of the golf club is not properly executed.

U.S. Pat. No. 4,139,198

Inventor: James G. Kanavas

Issued: Feb. 13, 1979

A training device which a golfer can attach to his putter to assist him in developing putting proficiency. The device consists of a rigid annulus having a flat back surface and a concave conical front surface that meet to form the inner edge of the annulus, the diameter of which is smaller than that of a conventional golf ball but large enough to permit the ball to contact the face of a putter to which the training device is attached without also contacting any part of the annulus. Attaching wings projecting in opposite directions from the annulus have flat back surfaces that are coplanar with the back surface of the annulus, to facilitate attaching the training device to a putter.

U.S. Pat. No. 4,877,251

Inventor: Wayne Faust

Issued: Oct. 31, 1989

A novelty putting device for a golf ball or facsimile thereof comprises the integral combination of a putter including a shaft and a putter head; a funnel-like guide tube having a tapered portion and including a guide track formed in the inner bottom surface thereof for guiding the movement of the ball after the ball is struck by the putter; and an L-shaped bracket connecting the guide tube to the putter and supporting the putter head in spaced relationship to the guide tube.

U.S. Pat. No. 4,962,927

Inventor: Nicholas Colucci

Issued: Oct. 16, 1990

A golf putter includes a horizontal flange extending rearward from the upper edge of a blade having a front face for striking golf balls. A pair of spaced apart narrow walls also extend rearward from the rear surface of the striking face and define an open space into which a golf ball may be wedged and retrieved. The flange and narrow walls provide weight centered on the blade's sweet spot. The upper surface of the flange may be provided with a sighting line to line up the putt with a target. The lower edges of the blade and vertical walls provide reduced resistance from grass during putting.

U.S. Pat. No. 5,011,153

Inventor: Thomas H. Watkins

Issued: Apr. 30, 1991

A golfer's putting aid is demountably secured to the putter head with a rubber band. The invention visually teaches the golfer to keep the putter head at a right angle relative to the sight line the golfer intends to putt the ball along. It is intended to teach the golfer not to twist the putter shaft while putting. The putting aid is a U-shaped bracket formed by a pair of spaced apart parallel fingers extending from a cross brace having a platform. The open ended rectangular cavity formed by the fingers and cross brace is large enough to surround a golf ball lying on the practice green and forms a guideway. There are a pair of spaced apart abutments with anchor posts located on the platform adjacent to the two interior corners of the cavity. The two abutments are vertical and abut against the face of the putter head. The two anchor posts secure the ends of the rubber band which is stretched underneath the cross brace. The stretched rubber band holds both ends of the putter head against the abutments. Both fingers visually exaggerate the angle of the face of the putter relative to the imaginary swing line while practicing one's putting.

U.S. Pat. No. 5,351,962

Inventor: Lung-Chian Lin

Issued: Oct. 4, 1994

A golf putting practice device permitting inspection of linear perpendicular movement gravitational center of a putting club, composed of a connecting seat, a perpendicular standard strip and a pad member, wherein the pad member is rectangular, formed with a standard line and a circle positioned at a middle portion of the standard line, whereby during the movements of aiming, moving back, moving forward, hitting and moving following the ball, the player is able to inspect whether the standard strip is overlapped on the standard line and correct the linear perpendicular putting movement to place the gravitational center of the putting club on the line connecting the golf ball and the ball hole so as to achieve a correct putting track and attitude.

U.S. Pat. No. 6,464,596

Inventor: Randy S. Belding

Issued: Oct. 15, 2002

A U-shaped alignment attachment is mounted on a putter and includes laterally inwardly spaced apart parallel leg extensions which have rearward ends spaced sufficiently from the golf ball when being addressed that they will engage the golf ball when the club is moved rearwardly on the backstroke if the club is off the intended line and engage the forward ends of the leg extensions on the forward stroke giving immediate feedback to the golfer as a result of the golf ball going off in an exaggerated miss/hit direction. Appropriate jaws are provided for mounting the attachment on different types of golf clubs.

U.K. Patent Number GB 1236982

Inventor: Gerard Matthew Jenkinson

Issued: Jun. 23, 1971

A practicing means for a ball game such as golf, comprises a handle member rigidly attached to a portion with an edge forming a striking boundary at a position defined by a linear translation through a distance equal to the ball radius, of at least the greater part of the boundary of a preferred striking area corresponding to a preferred striking area on a normal playing implement for the game, said edge at least partially defining an aperture, whereby, on use of the practicing means in a manner analogous to the use of the normal playing implement, contact between the ball and said edge indicates that, for a corresponding stroke made with a playing implement, the ball would have been struck outside the preferred striking area and passage of the ball through the aperture without contacting said edge indicates that an acceptable stroke has been played. An embodiment of the invention is shown in FIG. 2 wherein the portion referred to is a tube and FIG. 1 shows the aperture defined by linear translation of the preferred striking area through a distance equal to the ball radius.

Canadian Patent Number CA2,116,891

Inventor: Doria D. Iriarte, et al.

Issued: Sep. 5, 1994

The subject is a head for a golf club that can be based on a specific design, but the head is to have improvements incorporated in order to remove or diminish the vibrations caused by the movement of the head until it impacts with the ball. These improvements are the placing on the side of the head opposite to that on which the impact occurs, of some deep cavities that begin at the edge defined by the flows round the head as it moves. These cavities are parallel to the edges of the rear face and are joined by a central spine that separates them.

While these training devices may be suitable for the purposes for which they were designed, they would not be as suitable for the purposes of the present invention, as hereinafter described.

SUMMARY OF THE PRESENT INVENTION

The present invention discloses a golf swing training device comprising a golf club with a shaft with a grip at one end and a club head at the other end of the shaft with a cup attached to the face of the club head with the cup opening on the front towards the intended target. The bore of the cup conforms substantially to the diameter of the ball. In use, a ball is placed in the cup with the intention of releasing the ball from the cup at a desired point during the swing at a target. In practice, if during the back swing the cup is incorrectly tilted, due to poor swing mechanics, the ball will fall out. Also, if the bore of the cup is not in alignment with the target line at the ball's point of release the ball trajectory will be skewed from the target. As an additional element, the cup can have a circumferential ridge on the interior to impede the ball from easily falling out and the cup can be removably attached to the club head.

The present invention is a small, transportable golf swing training device to train a golfer to correctly swing a golf club. On the back swing, the golfer learns to take a low and slow swing along the target line while rotating the wrists properly. On the down swing, a golfer learns to rotate the wrists through the hitting area while extending the hands along the target line and improving the follow-through. By practicing with the device, a golfer should experience an improved swing leading to longer and straighter shots.

To begin the back swing, the golfer must take a low and slow take away along the target line while rotating the wrists properly; otherwise, the golf ball will fall out of the cup that is attached to the face of the device. A correct takeaway keeps the golf ball in the cup throughout the back swing. On the down swing, a golfer learns to rotate the wrists through the hitting area while extending the hands along the target line. If done correctly, the ball will leave the cup at the bottom of the swing and fly directly down the target line. Any swing other than a correct swing will cause the ball to go left, right, higher or lower of the target line. To further assist the golfer, the device can be used with two one-inch wide ribbons placed parallel to each other on the floor. One ribbon, approximately 3 feet long, is used to line up the golfer's feet. The other ribbon, approximately 12 feet long, is aligned with the imagined position of the golf ball along the target line. In addition, for the golfer to assess the results of their swing, they can affix a transportable bulls-eye to a wall located down the line of the 12-foot ribbon. This gives the golfer visual feedback of the trajectory of the ball as it leaves the cup.

A primary object of the present invention is to provide a golfer with a swing training device to develop a correct back swing, target line swing release and follow through.

Another object of the present invention is to provide a golf swing training device comprising a shaft having a cup attached to the face of a club head.

Yet another object of the present invention is to provide a golf swing training device wherein said cup aperture faces the front of the club.

Still yet another object of the present invention is to provide a golf swing training device wherein the bore of the cup is diametrically similar to the ball diameter.

A further object of the present invention is to provide an optional ridge on the interior of the cup to impede the ball easily rolling out.

Another object of the present invention is to provide a golf swing training device having an additional element in the form of one or more lengths of ribbon that aid in stance foot position and intended trajectory of the ball.

Yet another object of the present invention is to provide a golf swing training device that is easy to use.

Still yet another object of the present invention is to provide a golf swing training device that is cost effective to manufacture.

Yet another object of the present invention is to provide a transportable swing training device that fits in travel luggage.

Additional objects of the present invention will appear as the description proceeds.

The present invention overcomes the shortcomings of the prior art by providing a golf swing training device comprising a club head and shaft having a cup attached thereto with the cup opening on the front towards the intended target. The bore of the cup conforms substantially to the diameter of the ball. In use a ball is placed in the cup with the intention of releasing the ball from the cup at a desired point during the swing at a target. In practice, if during the back swing the cup is tilted the ball will fall out or if when released the bore of the cup is not in alignment with the target, the ball trajectory is skewed from the target. The advantage of the present invention is it helps the golfer develop a back swing along the correct swing plane, at a slow pace, rolling the hands open to keep the ball from falling out of the cup and to extend the hands along the target line on downswing. If the swing is done correctly, the ball will leave the cup at the bottom of the swing and fly directly down the target line. Any swing other than a correct swing will cause the ball to go left, right, higher or lower of the target line.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
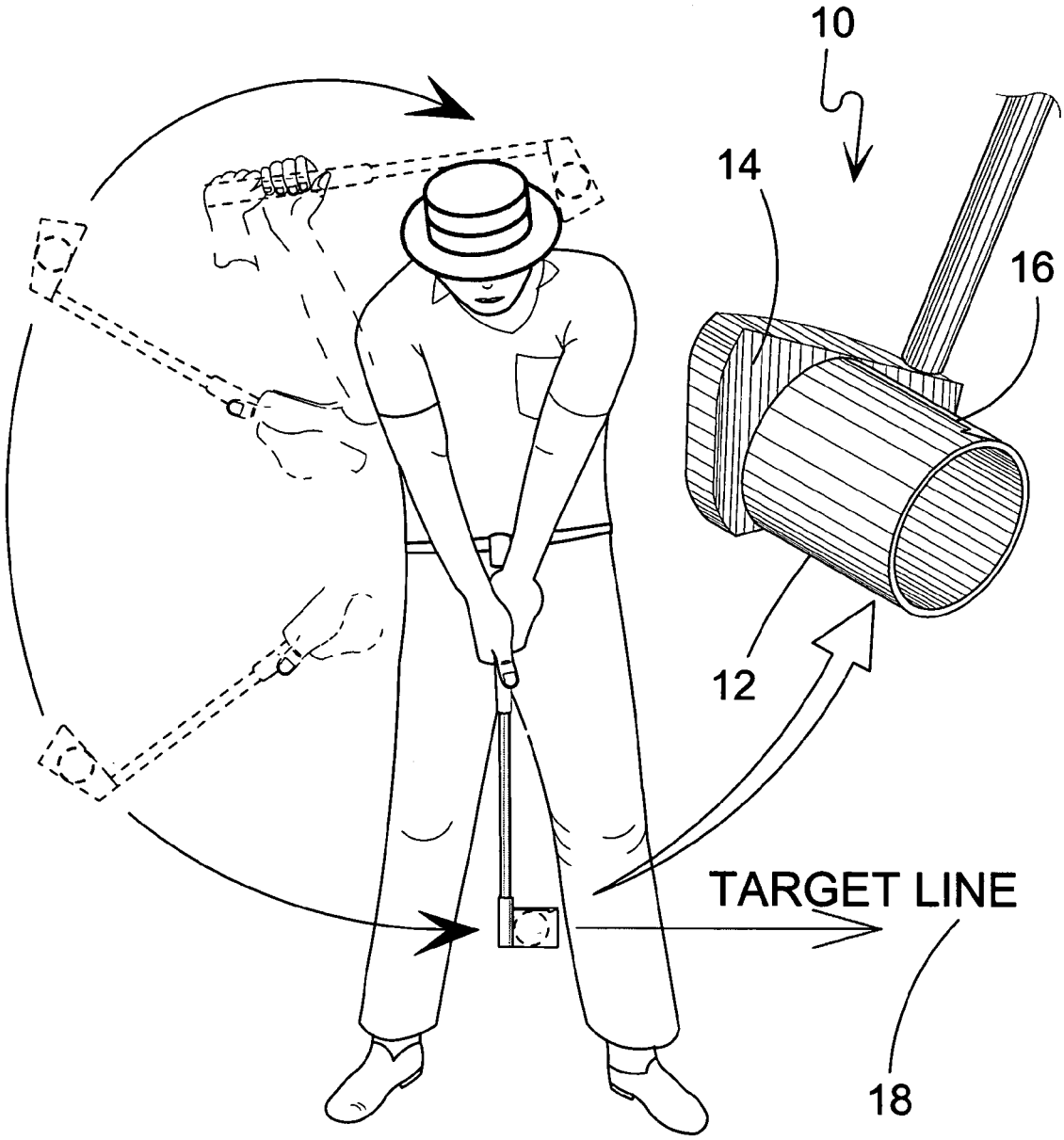
FIG. 1 is an illustrative view of the present invention in use.

With regard to reference numerals used, the following numbering is used throughout the drawings.

| | |
|---|---|
| 10 | present invention |
| 12 | cup |
| 14 | face |
| 16 | arrow |
| 18 | target line |
| 20 | golf club |
| 22 | grip |
| 24 | shaft |
| 26 | club head |
| 28 | ball |
| 30 | long ribbon |
| 32 | short ribbon |
| 34 | golfer |
| 36 | male threads |
| 38 | female threads |
| 40 | ridge |
| 41 | target |
| 42 | clamp |
| 44 | clamp fasteners |
| 46 | clamp arm |
| 48 | double face tape |
| 50 | mounting frame |
| 51 | club head mounting frame member |
| 52 | cup mounted frame member |
| 53 | mounting frame hinge |
| 54 | slide stay |
| 56 | slide pivot |
| 58 | slide set screw |
| 60 | slide aperture |
| 62 | strap loop |
| 64 | frame mounting apertures |
| 66 | cup mounted bristles |
| 68 | safety strap anchor |
| 70 | adjuster strap |
| 72 | adjuster strap apertures |
| 74 | adjuster strap post |
| 100 | shaft mounted golf swing training device |
| 200 | golf club - head mounted golf swing training device |
| 300 | golf club - head mounted golf swing training device |
| 400 | golf club - head mounted golf swing training device |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 discloses a golf swing training device comprised of a cup 12 mounted to a club face 14 for placing a ball therein and dispensing the ball. The cup 12 has an exteriorly positioned marker or arrow 16 used as an alignment aid with a target. Also shown is the target line at 18.

Figure 2:
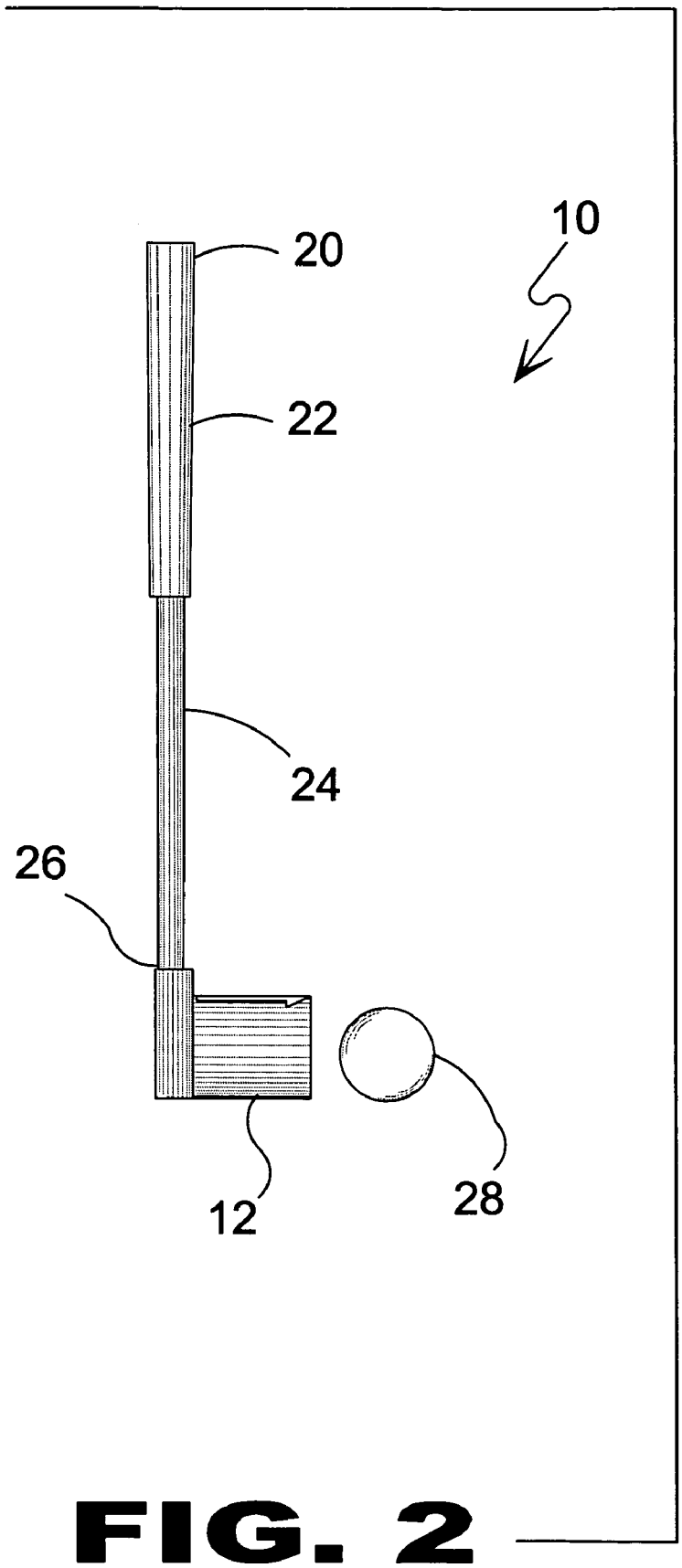
FIG. 2 is a side view of the present invention.

Turning to FIG. 2, shown therein is a side view of the present invention 10. Shown is the present invention 10 disclosing a small, transportable golf swing training device to train a golfer to correctly swing a golf club 20. On the back swing, the golfer learns to take a low and slow swing along the target line while rotating the wrists properly. On the down swing, a golfer learns to rotate the wrists through the hitting area while extending the hands along the target line and improving the follow-through. By practicing with the device, a golfer should experience an improved swing leading to longer and straighter shots. Also shown are the grip 22, shaft 24, club head 26, cup 12 and ball 28.

Figure 3:
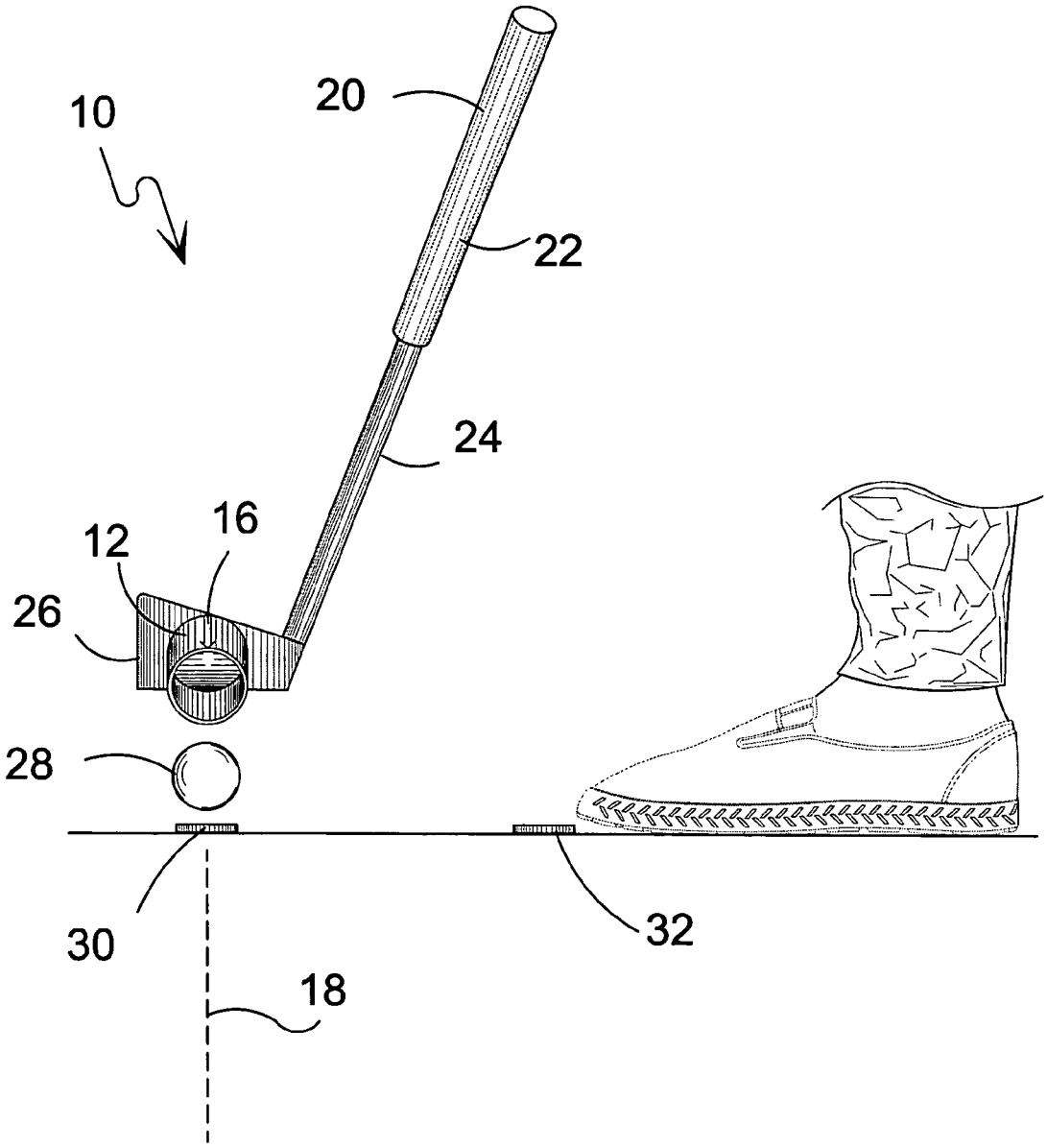
FIG. 3 is a frontal view of the present invention.

Turning to FIG. 3, shown therein is a frontal view of the present invention 10. Shown is the present invention 10 disclosing a small, transportable golf swing training device to train a golfer to correctly swing a golf club 20. On the back swing, the golfer learns to take a low and slow swing along the target line while rotating the wrists properly. On the down swing, a golfer learns to rotate the wrists through the hitting area while extending the hands along the target line and improving the follow-through. By practicing with the device 10, a golfer should experience an improved swing leading to longer and straighter shots. Also shown are a long target line ribbon 30, target line 18, a short stance ribbon 32 and other previously disclosed elements.

Figure 4:
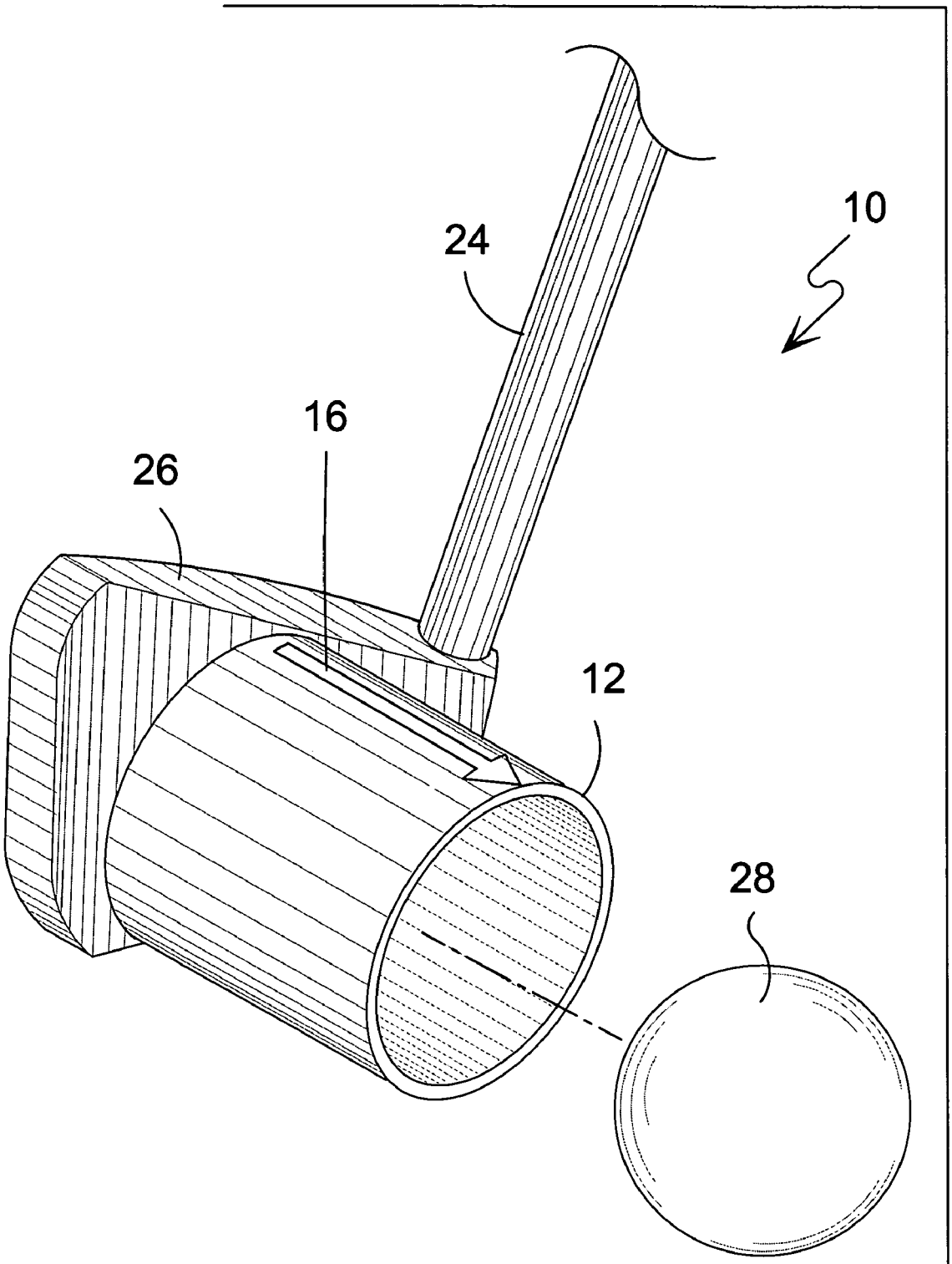
FIG. 4 is a detailed perspective view of the present invention.

Turning to FIG. 4, shown therein is a detailed perspective view of the present invention 10. Shown is the present invention 10 disclosing a small, transportable golf swing training device to train a golfer to correctly swing a golf club. On the back swing, the golfer learns to take a low and slow swing along the target line while rotating the wrists properly. On the down swing, a golfer learns to rotate the wrists through the hitting area while extending the hands along the target line and improving the follow-through. By practicing with the device 10, a golfer should experience an improved swing leading to longer and straighter shots. Other elements previously shown are also disclosed.

Figure 5:
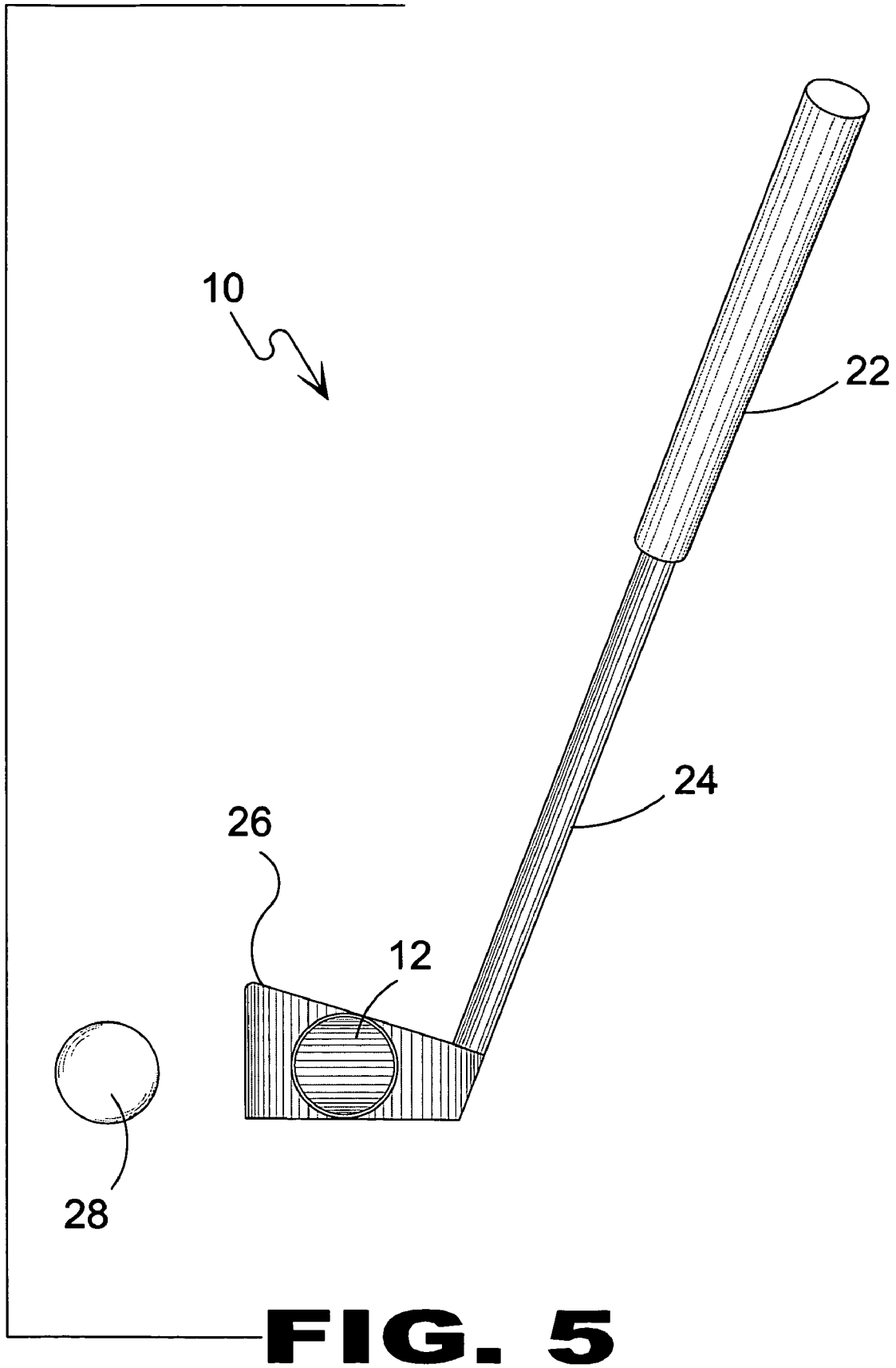
FIG. 5 is a frontal view of the present invention.

Turning to FIG. 5, shown therein is an exploded perspective view of the present invention 10. Shown is the present invention 10 disclosing a small, transportable golf swing training device to train a golfer to correctly swing a golf club. On the back swing, the golfer learns to take a low and slow swing along the target line while rotating the wrists properly. On the down swing, a golfer learns to rotate the wrists through the hitting area while extending the hands along the target line and improving the follow-through. By practicing with the device 10, a golfer should experience an improved swing leading to longer and straighter shots. Other elements previously shown are also disclosed.

Figure 6:
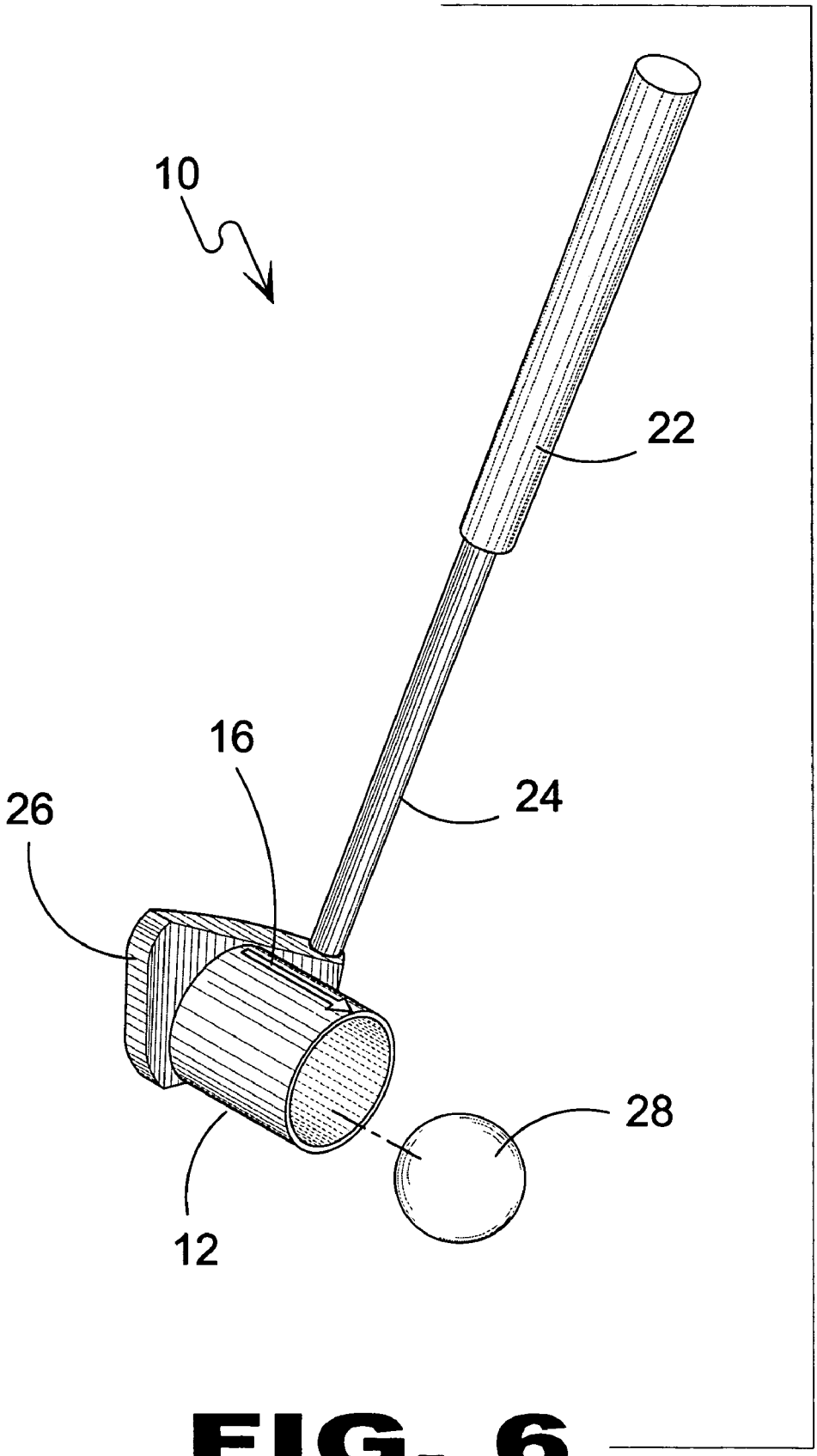
FIG. 6 is a perspective view of the present invention.

Turning to FIG. 6, shown therein is a perspective view of the present invention 10. Shown is the present invention 10 disclosing a small, transportable golf swing training device to train a golfer to correctly swing a golf club. On the back swing, the golfer learns to take a low and slow swing along the target line while rotating the wrists properly. On the down swing, a golfer learns to rotate the wrists through the hitting area while extending the hands along the target line and improving the follow-through. By practicing with the device 10, a golfer should experience an improved swing leading to longer and straighter shots. Other elements previously disclosed are also shown.

Figure 7:
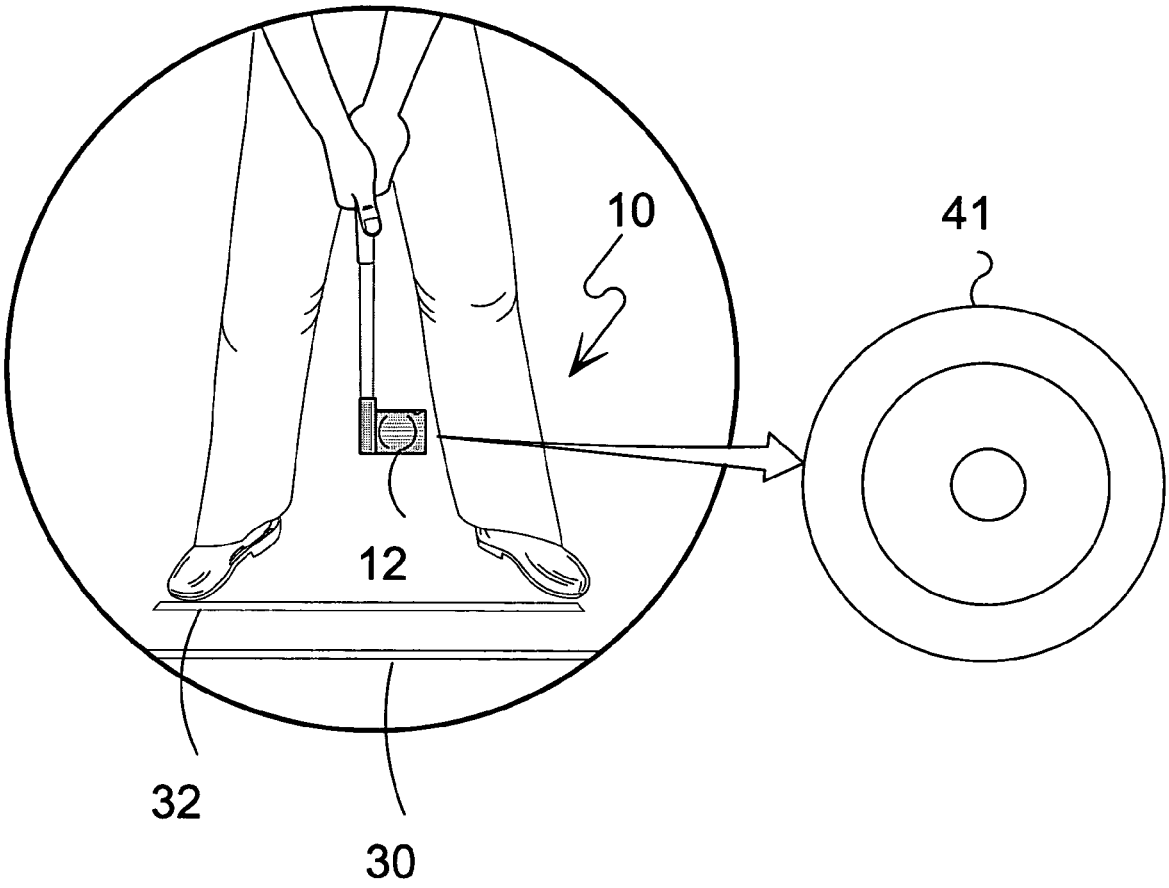
FIG. 7 is an illustrative view of the present invention.

Turning to FIG. 7, shown therein is an illustrative view of the present invention 10. Shown is the present invention 10 disclosing a small transportable golf swing training device to help a golfer learn to make a low, slow back swing, rotate the wrist properly and to extend the club head along the target line on the down swing. The device 10 is capable of slinging a plastic practice golf ball or a regulation golf ball forward toward a target. The device 10 also helps train a golfer to extend the hands down the target line. The device 10 comprises a cup 12 mounted to a club head, which is attached to a shaft with a grip. Also shown is portable target 41 placed down the line of the ribbon 30.

Figure 8:
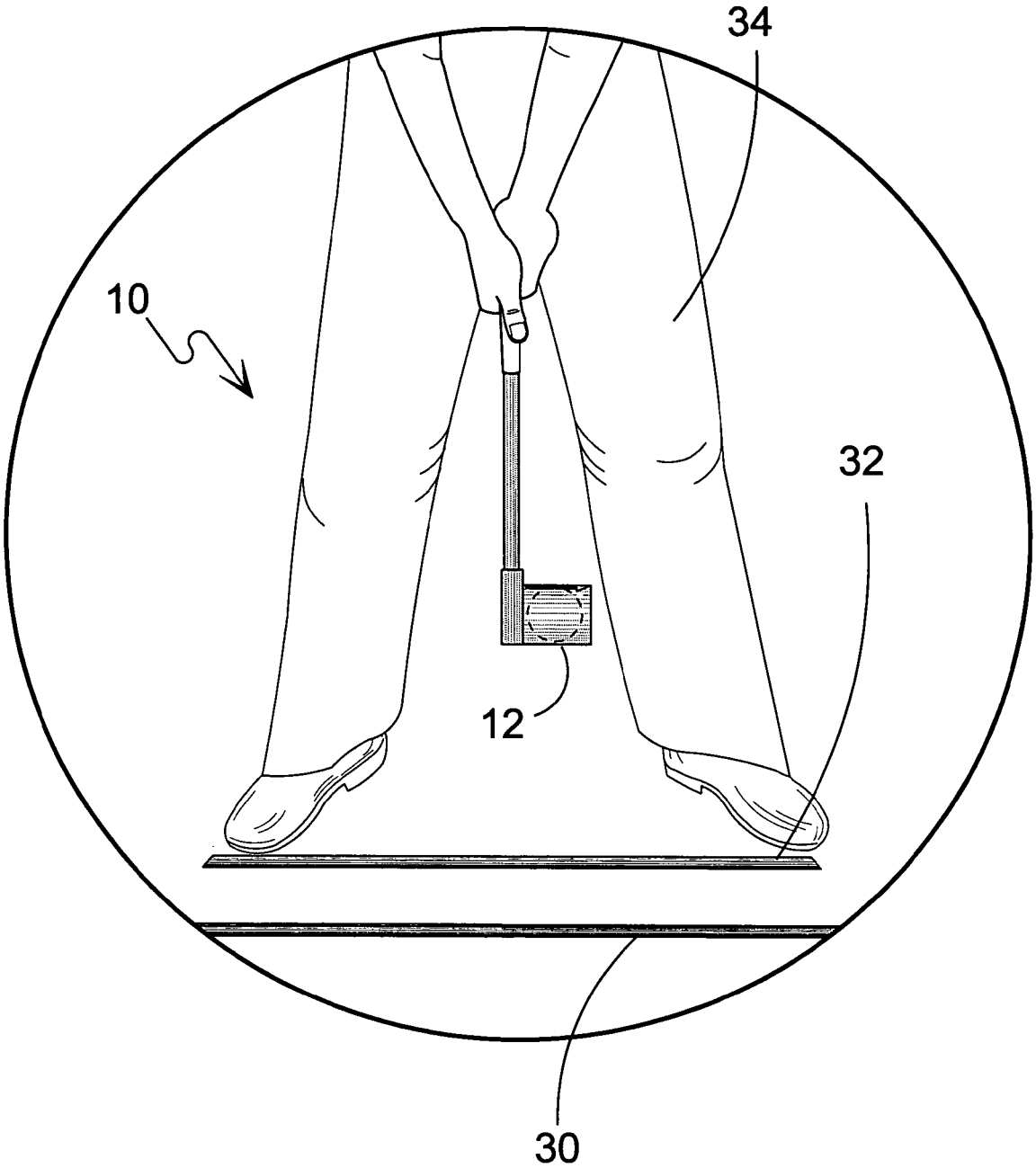
FIG. 8 is an illustrated view of the present invention.

Turning to FIG. 8, shown therein is an illustrated view of the present invention 10. To begin the back swing, the golfer 34 must take a low and slow takeaway along the target line while rotating the wrists properly; otherwise, the golf ball will fall out of the cup 12 that is attached to the face of the device. A correct takeaway keeps the golf ball in the cup 12 throughout the back swing. On the down swing, a golfer learns to rotate the wrists through the hitting area while extending the hands along the target line. If done correctly, the ball will leave the cup 12 at the bottom of the swing and fly directly down the target line. Any swing other than a correct swing will cause the ball to go left, right, higher or lower of the target line. To further assist the golfer, the device 10 can be used with two one-inch wide ribbons 30, 32 placed parallel to each other on the floor. One ribbon 32, approximately 3 feet long, is used to line up the golfer's feet. The other ribbon 30, approximately 12 feet long, is aligned with the imagined position of the golf ball along the target line. In addition, for the golfer 34 to assess the results of their swing, they can affix a transportable bulls-eye to a wall located down the line of the 12-foot ribbon 30. This gives the golfer 34 visual feedback of the trajectory of the ball as it leaves the cup 12.

Figure 9:
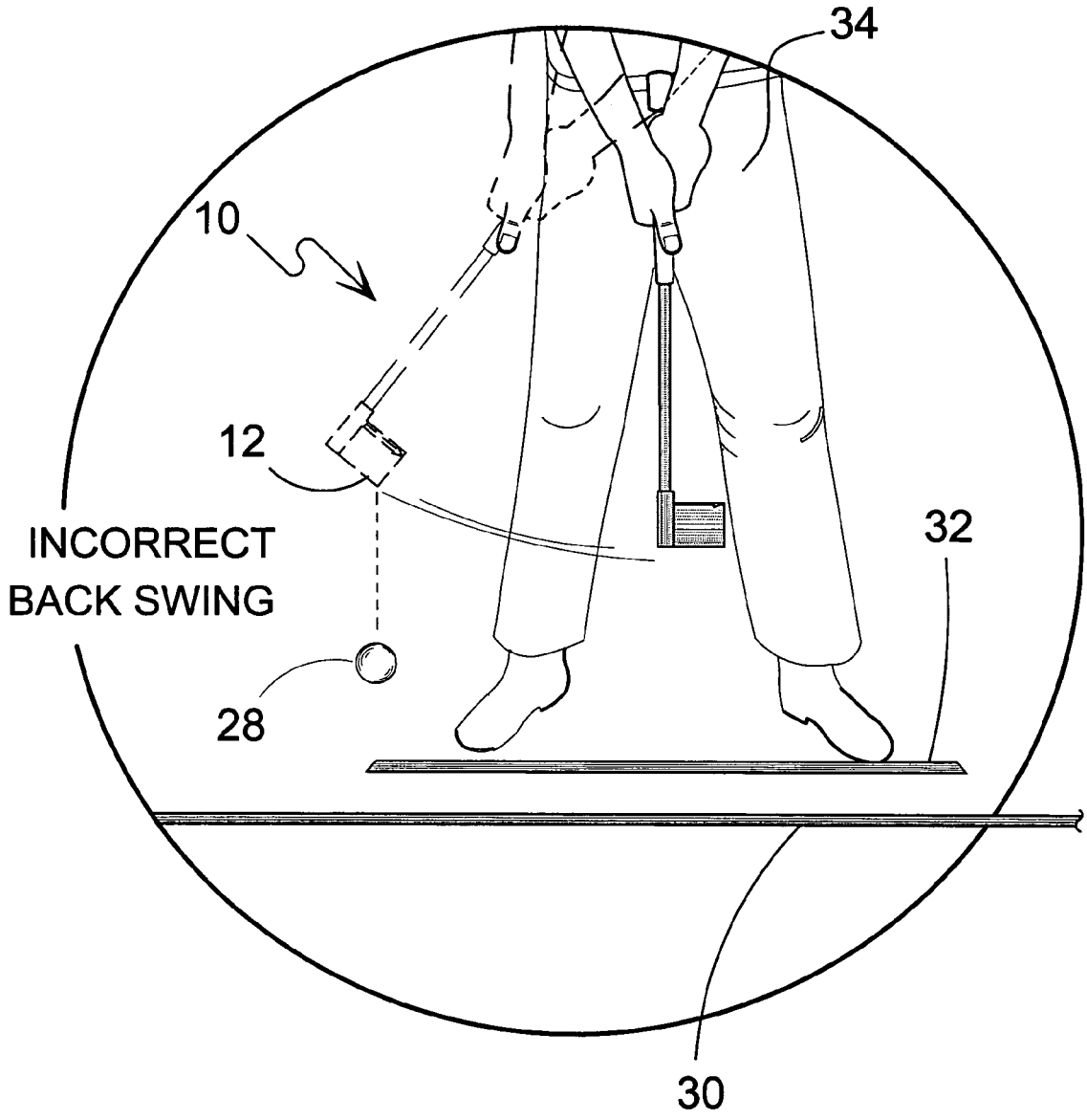
FIG. 9 is an illustrated view of the present invention.

Turning to FIG. 9, shown therein is an illustrated view of the present invention 10 showing an incorrect back swing. To begin the back swing, the golfer 34 must take a low and slow takeaway along the target line while rotating the wrists properly; otherwise, the golf ball 28 will fall out of the cup 12 that is attached to the face of the device. A correct takeaway keeps the golf ball 28 in the cup 12 throughout the back swing. On the down swing, a golfer 34 learns to rotate the wrists through the hitting area while extending the hands along the target line. If done correctly, the ball 28 will leave the cup 12 at the bottom of the swing and fly directly down the target line. Any swing other than a correct swing will cause the ball 28 to go left, right, higher or lower of the target line. To further assist the golfer 34, the device can be used with two one-inch wide ribbons 30, 32 placed parallel to each other on the floor. One ribbon 32, approximately 3 feet long, is used to line up the golfer's feet. The other ribbon 30, approximately 12 feet long, is aligned with the imagined position of the golf ball along the target line. In addition, for the golfer to assess the results of their swing, they can affix a transportable bulls-eye to a wall located down the line of the 12-foot ribbon. This gives the golfer 34 visual feedback of the trajectory of the ball 28 as it leaves the cup 12.

Figure 10:
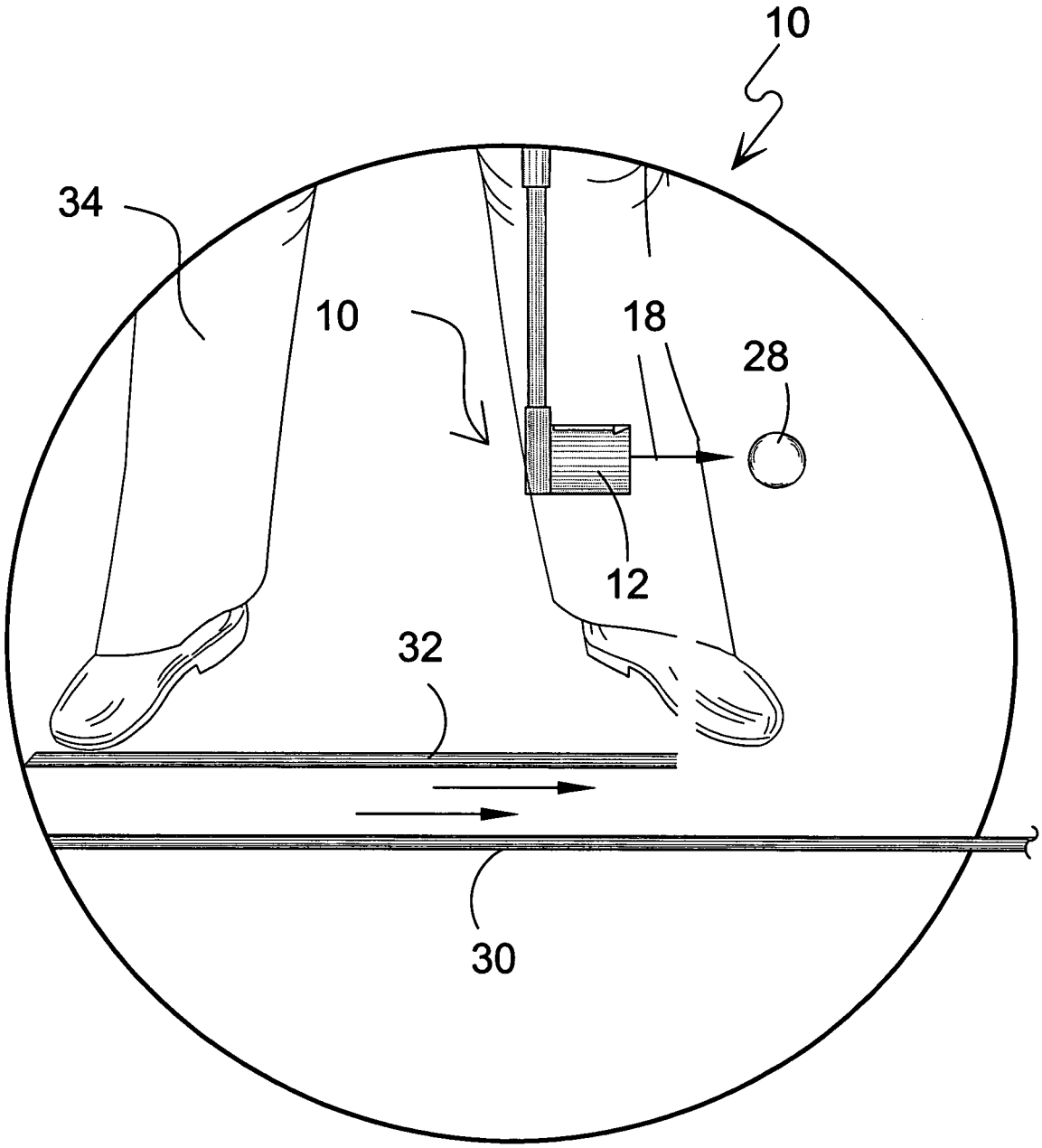
FIG. 10 is an illustrated view of the present invention.

Turning to FIG. 10, shown therein is an illustrated view of the present invention 10. To begin the back swing, the golfer 34 must take a low and slow takeaway along the target line 18 while rotating the wrists properly; otherwise, the golf ball will fall out of the cup 12 that is attached to the face of the device. A correct takeaway keeps the golf ball 28 in the cup 12 throughout the back swing. On the down swing, a golfer 34 learns to rotate the wrists through the hitting area while extending the hands along the target line. If done correctly, the ball 28 will leave the cup 12 at the bottom of the swing and fly directly down the target line 18. Any swing other than a correct swing will cause the ball to go left, right, higher or lower of the target line 18. To further assist the golfer, the device can be used with two one-inch wide ribbons placed parallel to each other on the floor. One ribbon 32, approximately 3 feet long, is used to line up the golfer's feet. The other ribbon 30, approximately 12 feet long, is aligned with the imagined position of the golf ball along the target line. In addition, for the golfer to assess the results of their swing, they can affix a transportable bulls-eye to a wall located down the line of the 12-foot ribbon. This gives the golfer 34 visual feedback of the trajectory of the ball 28 as it leaves the cup 12.

Figure 11:
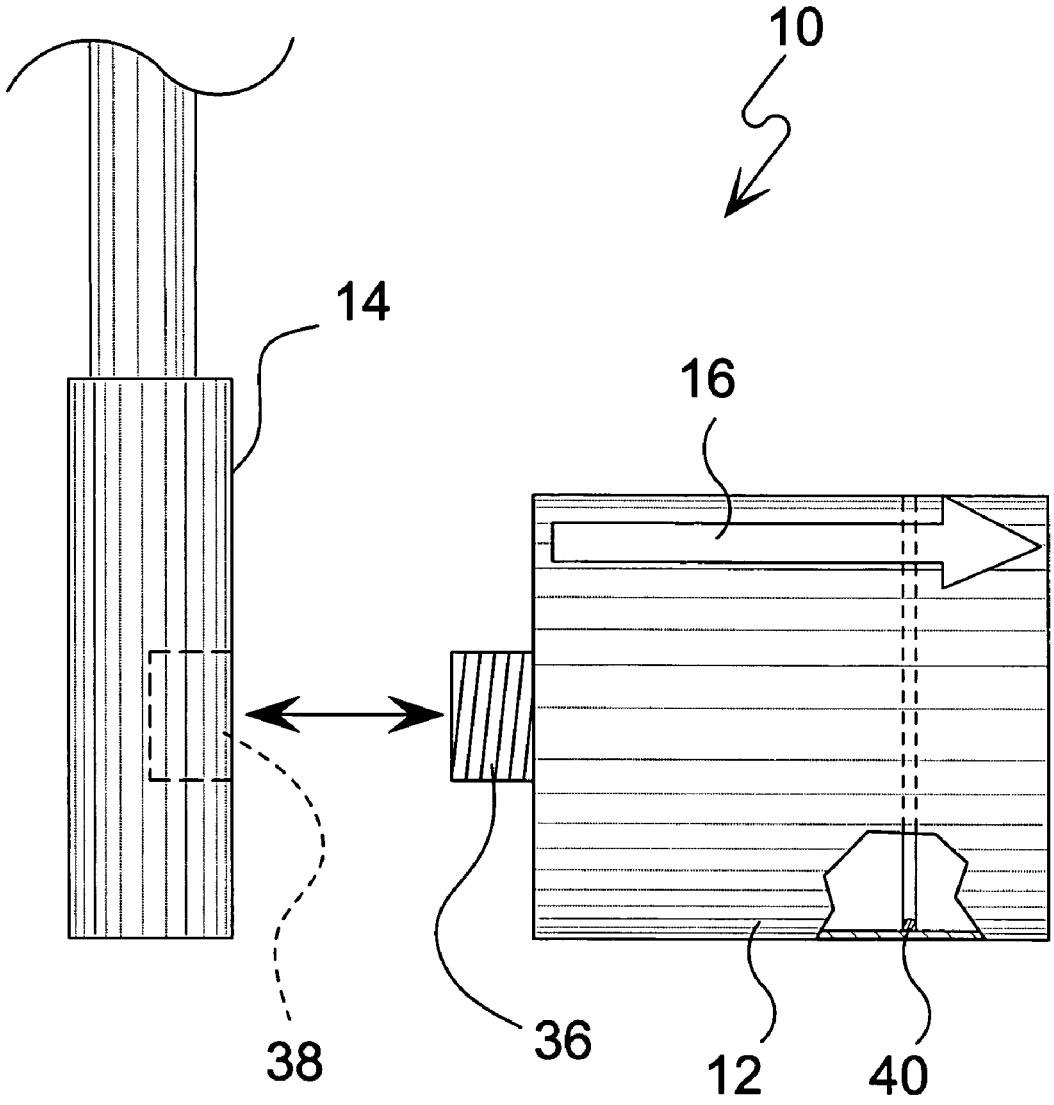
FIG. 11 is a side view of an additional element of the present invention.

Turning to FIG. 11, shown therein is a side view of an additional element of the present invention. Shown is an additional element of the present invention wherein the cup 12 is removably fastened to the club face 14. The cup 12 has a male threaded member 36 and the club head 14 has a female threaded bore 38. The cup 12 may incorporate a circumferentially positioned interior ridge 40 to retard the ball from easily falling out.

Figure 12:
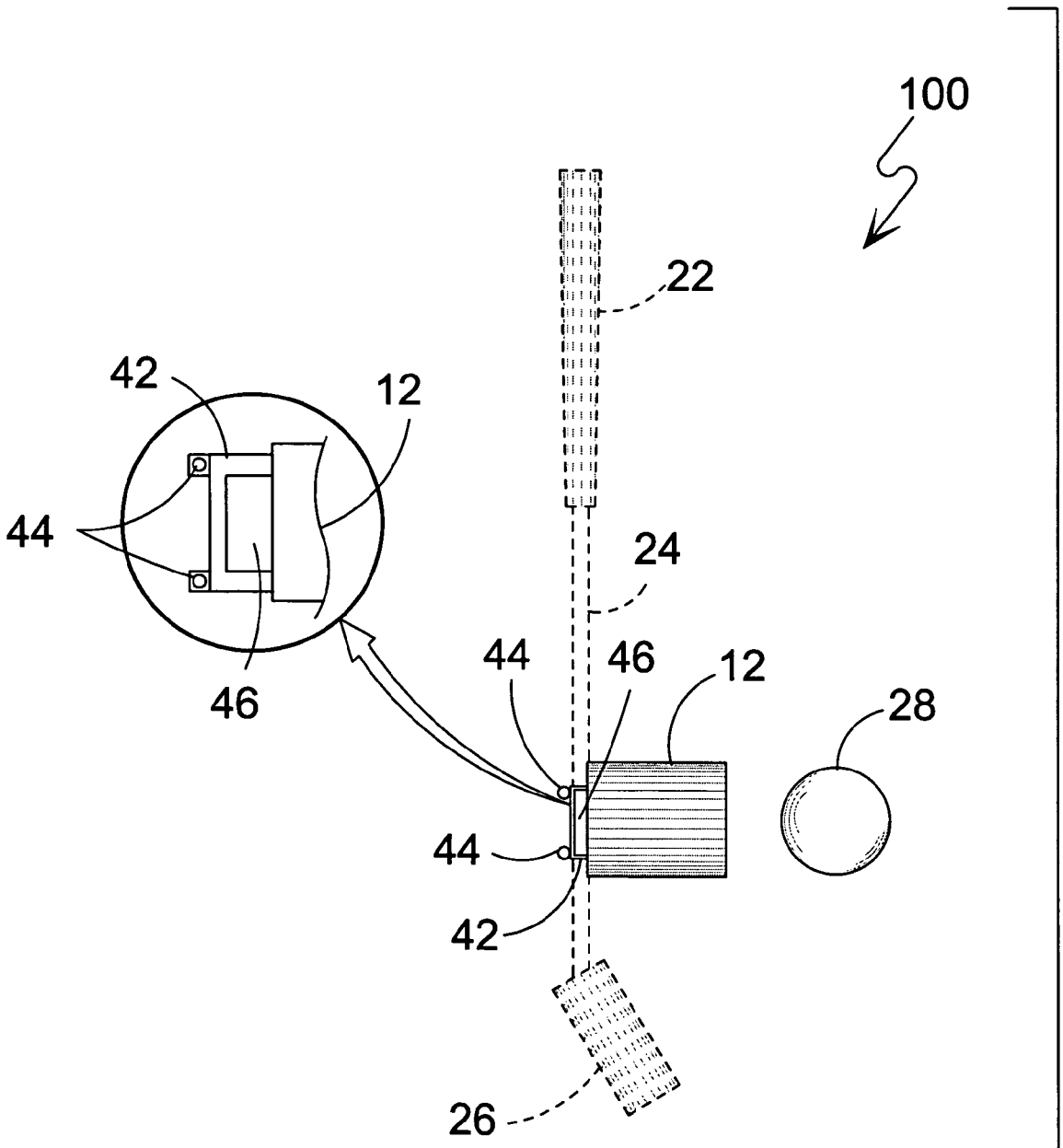
FIG. 12 is a side view of the shaft mounted version of the present invention.

Turning to FIG. 12, shown therein is a side view of an additional element of the present invention. Shown is an additional element of the present invention wherein the golf swing training device 100 incorporates means for attachment to any golf club shaft 24 by integrating cup 12 and clamp 42 thereby enabling the golfer to selectively attach the present invention 100 to any desired club.

Figure 13:
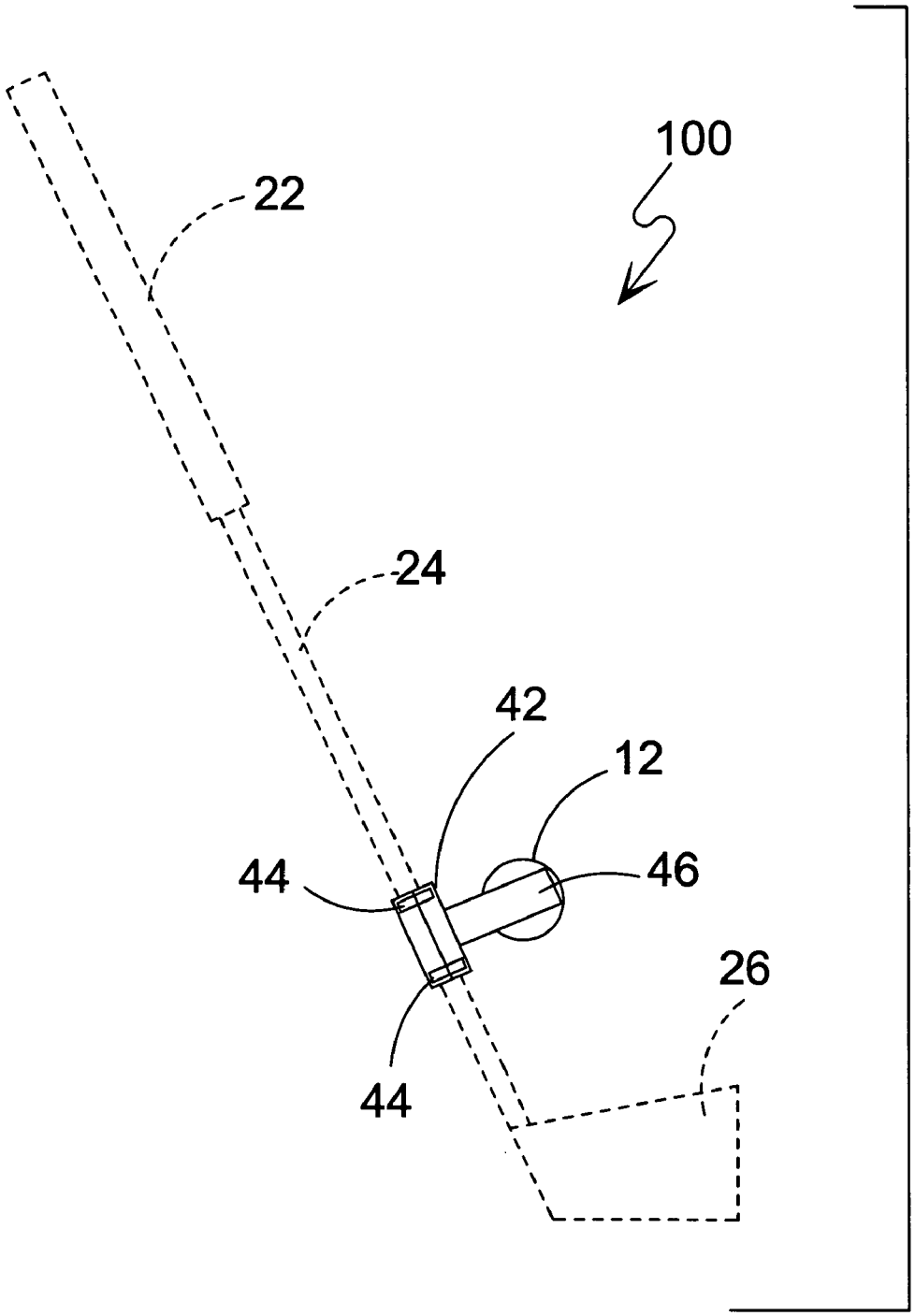
FIG. 13 is a back view of the shaft mounted version of the present invention.

Turning to FIG. 13, shown is a back view of the mountable golf swing training device. Shown is the golf swing training device 100 comprising cup 12 selectively attached to golf club shaft 24 using clamp 42 comprising mating clamp members having clamp fastening apertures for the insertion therein of a fastener. Extending from one of the mating clamp members in cantilevered fashion is clamp arm 46 with cup 12 mounted thereon.

Figure 14:
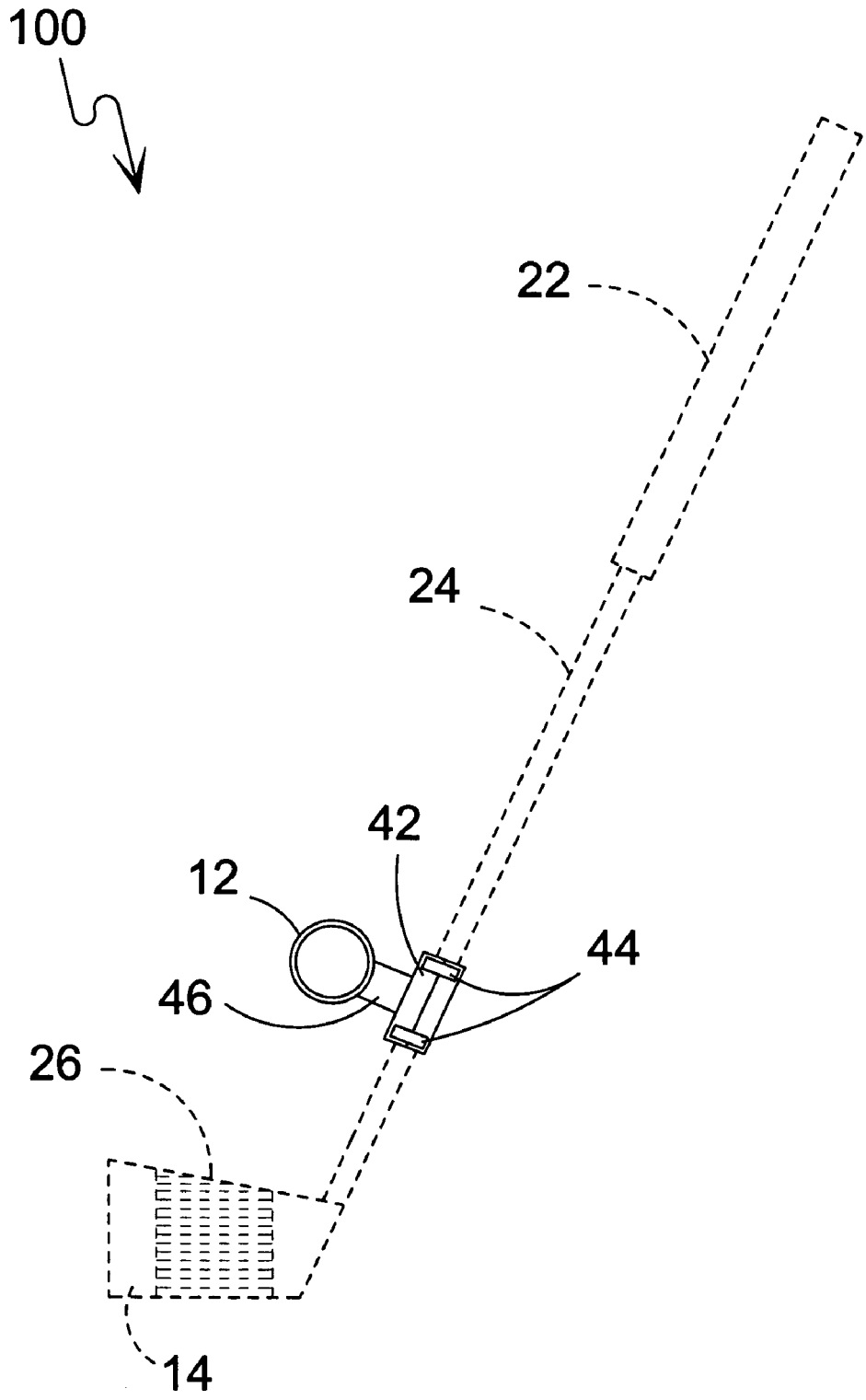
FIG. 14 is a front view of the shaft mounted version of the present invention.

Turning to FIG. 14, shown is a front view of the mountable golf swing training device. Shown is the present invention 100 mounted to a golf club having grip 22, shaft 24 and club head 26. The golf swing training device has mating members forming clamp 42 whereby said device can be selectively mounted to any desired golf club. Each of the members has a threaded throughbore for insertion therein of fasteners releasably fixing the device to a golf club shaft 24. Cantilevered from one of the clamp members is clamp arm 46 having cup 12 thereon.

Figure 15:
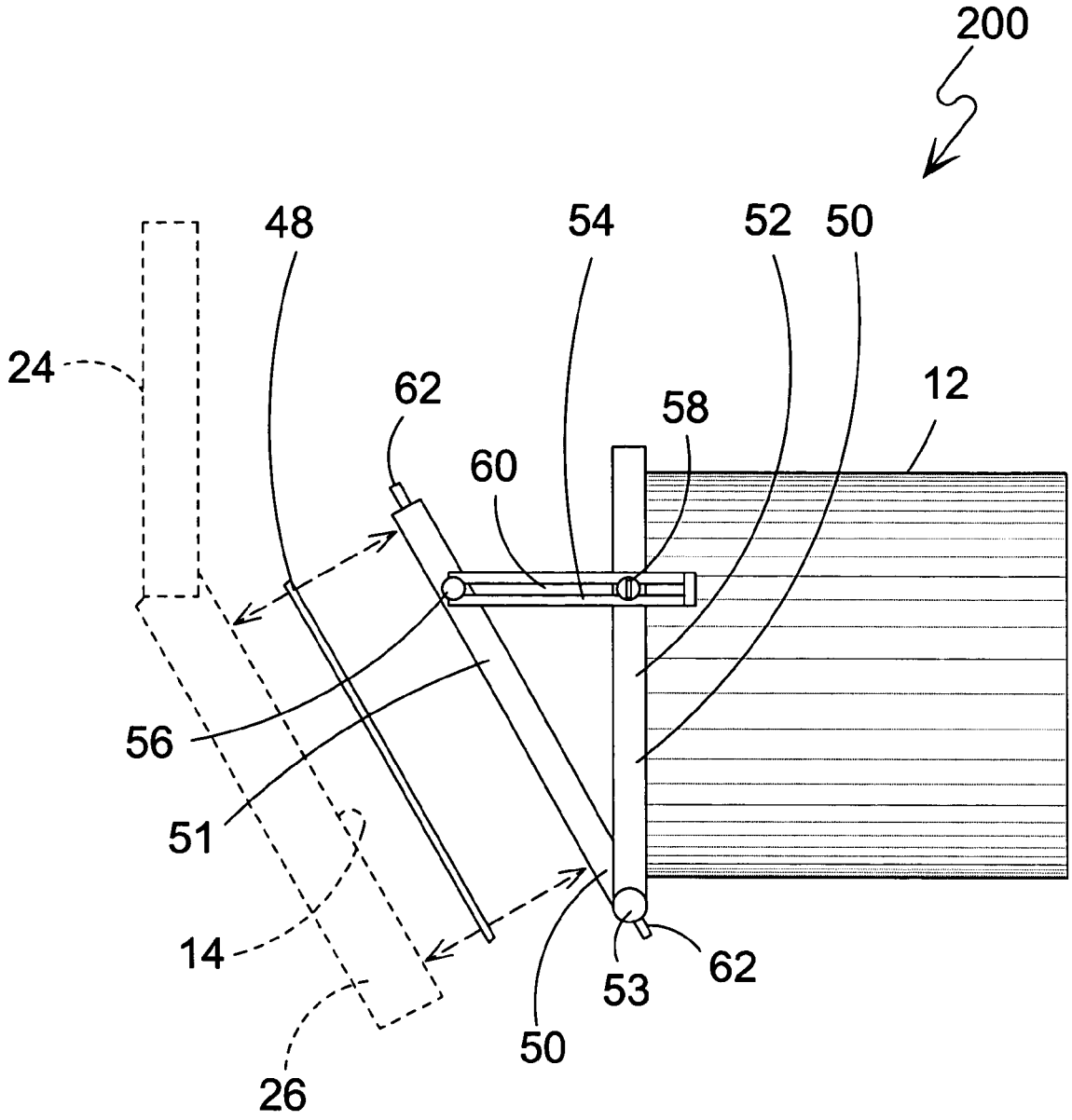
FIG. 15 is a side view of the golf club face mounted version of the present invention.

Turning to FIG. 15, shown therein is a side view of another additional element of the present invention. Shown is another additional element of the present invention wherein the golf swing training device 200 incorporates a mountable frame 50 having pivotal members 51, 52 that provide means for adjusting the cup angle relative to the mounted surface, which in this case is club face 14. Once the desired angle has been determined. Set screw 58 is tightened to fix the angle between golf club head 26 and cup 12.

Figure 16:
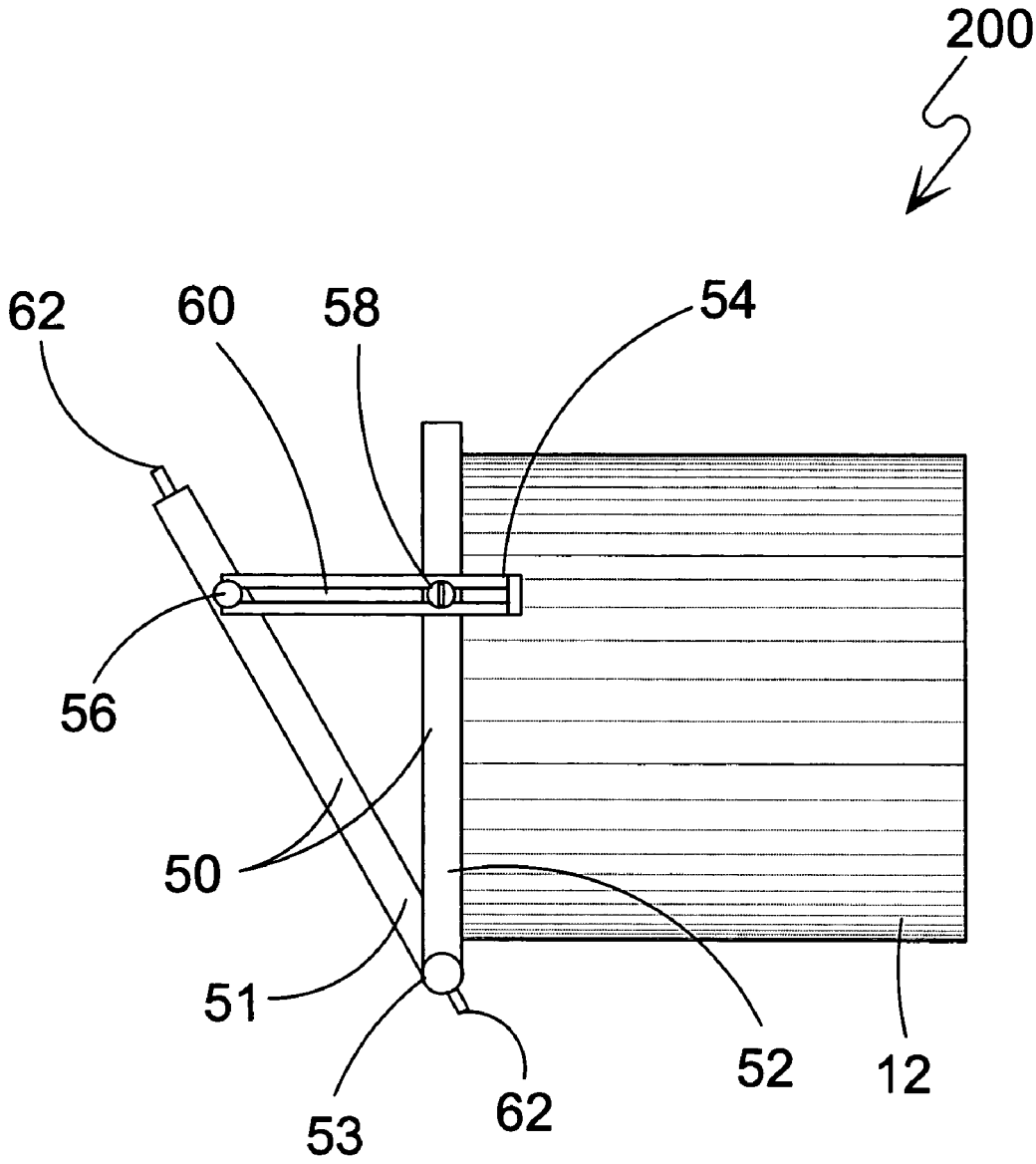
FIG. 16 is a side view of the golf club face mounted version of the present invention.

Turning to FIG. 16, shown therein is a side view of another additional element of the present invention. The present invention 200 provides for another means of attaching the present invention to a golf club head 26. The additional means incorporates a mounting frame 50 comprising two planar members 51, 52 pivotally connected by frame hinge 53 with slide stay 54 for fixedly setting a desired angle between the pivotal members. Slide stay 54 is pivotally anchored 56 to one of the frame members with slide stay 54 having a longitudinal slot 60 with set screw 58, which is threadedly fastened to the other mounting frame member, traveling therein. In operation, the present invention 200 is fastened to a golf club face 14 whereupon the user loosens the mounting frame set screw 58, adjusts the cup 12 to the desired angle and tightens set screw 58.

Figure 17:
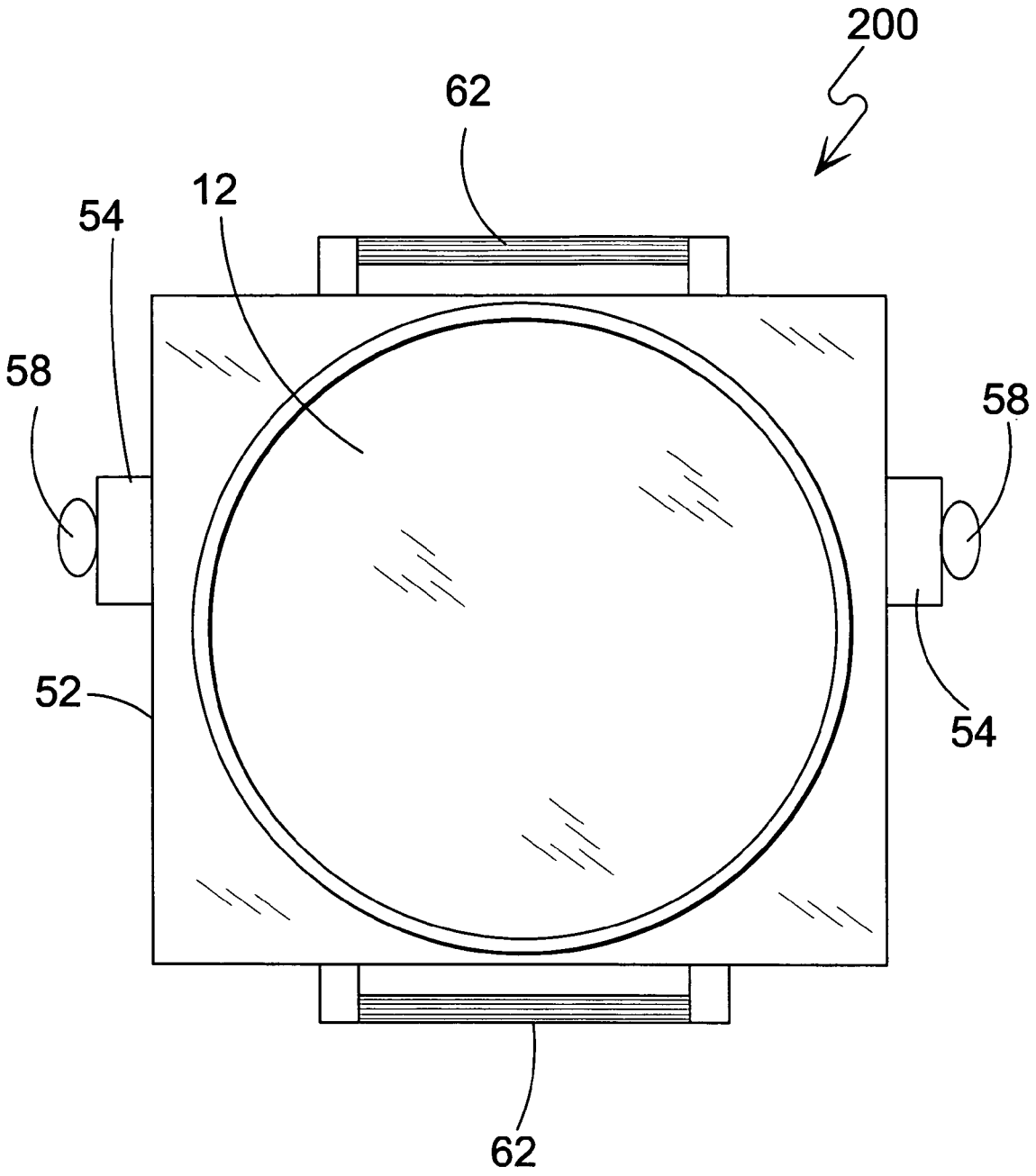
FIG. 17 is a front view of the golf club face mounted version of the present invention.

Turning to FIG. 17, shown is a front view of the mountable golf swing training device. Shown is the present invention 200 comprising mountable frame 50 having cup 12 mounted thereon. Angular adjustment of cup 12 relative to golf club head 26 is achieved by loosening set screw 58 traveling in slide aperture 60 of slide 54. When the desired angle has been determined, set screw 58 is tightened and the present invention 200 is ready for use. The present invention 200 also provides for additional means for securing the present invention 200 to golf club head 26 by incorporating strap loops 62 positioned on the top and bottom side of that portion of mounting frame 50 that fastens to golf club head 26. Strap loops 62 can have a length of hook and loop material extending from one strap loop over the back side of club head 26 and releasably fastened to the other strap loop 62 thereby providing an additional means of mounting the present invention 200 comprised of mounting frame 50.

Figure 18:
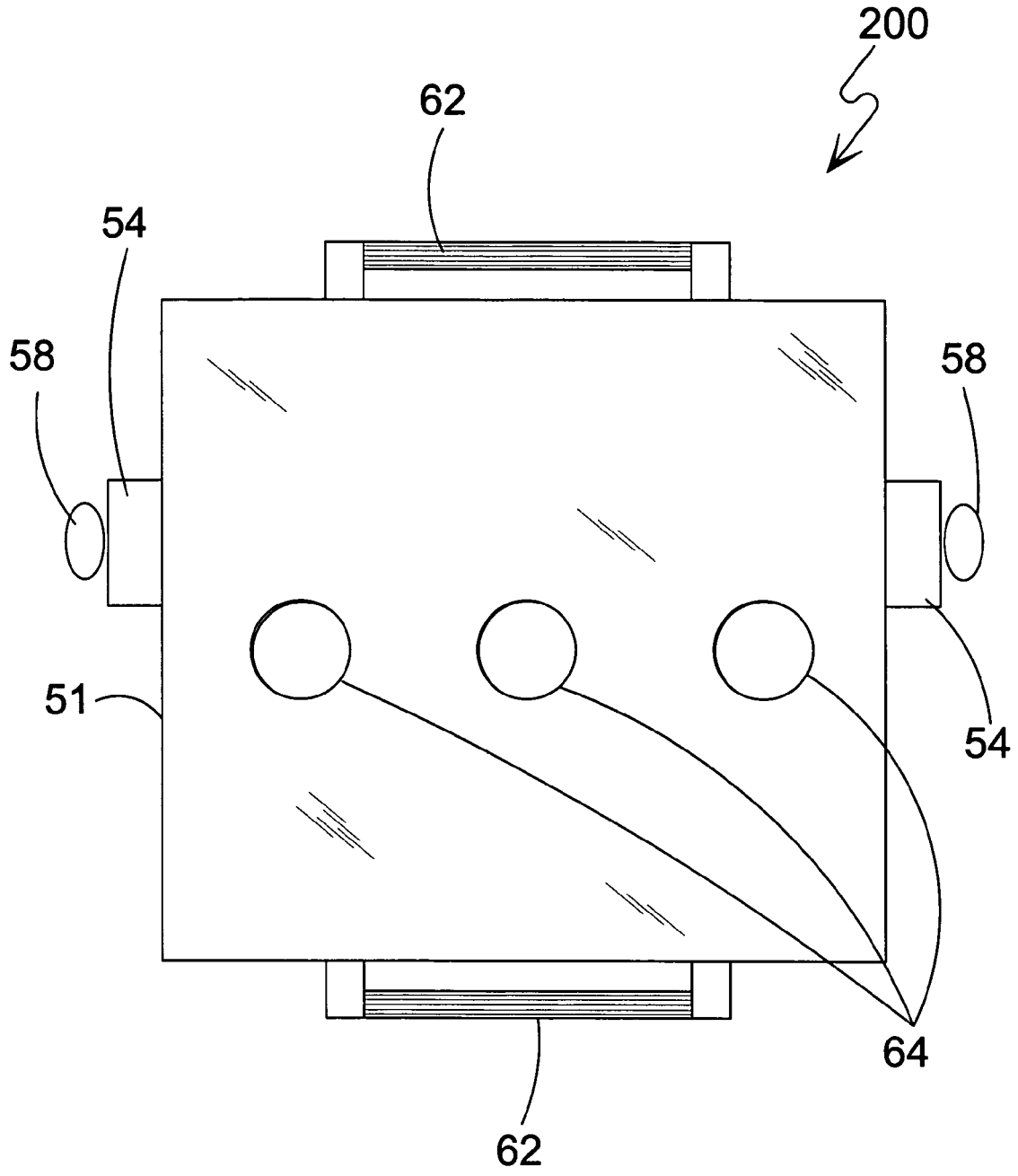
FIG. 18 is a back view of the golf club face mounted version of the present invention.

Turning to FIG. 18, shown is a back view of the golf club head mountable golf swing training device. Shown is a back view of mounting frame 50 that mounts to golf club face 14 of golf club head 26. As previously stated, angular adjustment of cup 12 relative to golf club head 26 is achieved by loosening set screw 58 traveling in slide aperture 60 of slide 54. When the desired angle has been determined, set screw 58 is tightened and the present invention 200 is ready for use. The present invention 200 also provides for additional means for securing the present invention 200 to golf club head 26 by incorporating strap loops 62 positioned on the top and bottom side of that portion of mounting frame 50 that fastens to golf club head 26. Strap loops 62 can have a length of hook and loop material extending from one strap loop over the back side of club head 26 and releasably fastened to the other strap loop 62 thereby providing an additional means of mounting the present invention 200 comprised of mounting frame 50. Additionally, the present invention provides frame mounting apertures 64 whereby the present invention can be releasably fixed to golf club head 26 using appropriated fasteners.

Figure 19:
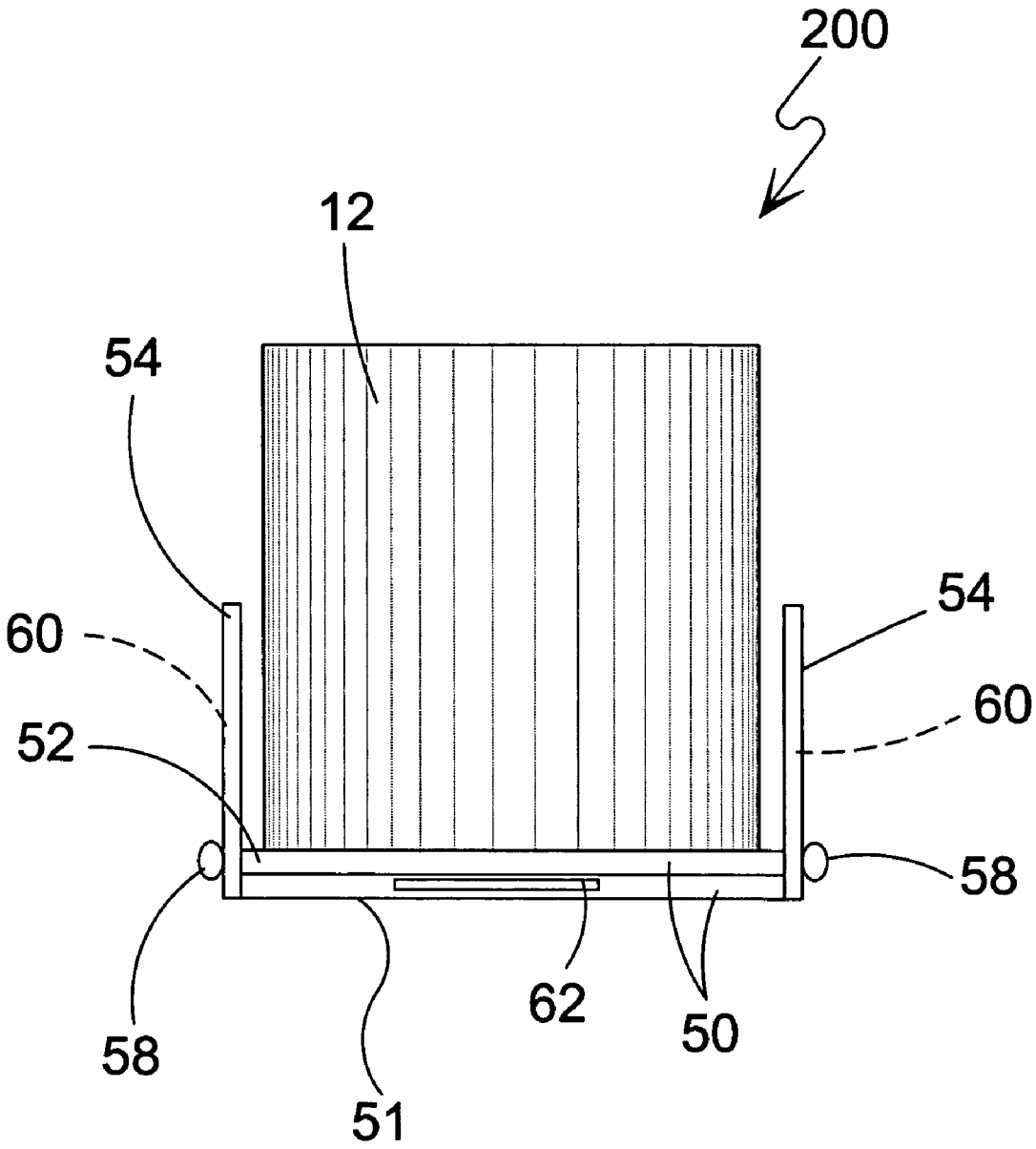
FIG. 19 is a top view of the golf club face mounted version of the present invention.

Turning to FIG. 19, shown therein is a top view of the golf club head mountable golf swing training device 200 of the present invention. Mounting frame 50 is comprised of pivotally fastened planar member. As illustrated, the front pivotal member 52 has cup 12 depending therefrom with set screws 58 located on opposing sides traveling in longitudinal slot 60 of slide 54. Slide 54 is pivotally fastened to the back pivotal frame member 51. Since the front and back frame members 51, 52 are hingedly fastened at the base using mounting frame hinge 53, angular divergence of the front pivotal frame member 52 relative to the back pivotal frame member 51 is therein provided with slide stay 54 and set screws 58 providing means for releasably fixing the desired angular displacement.

Figure 20:
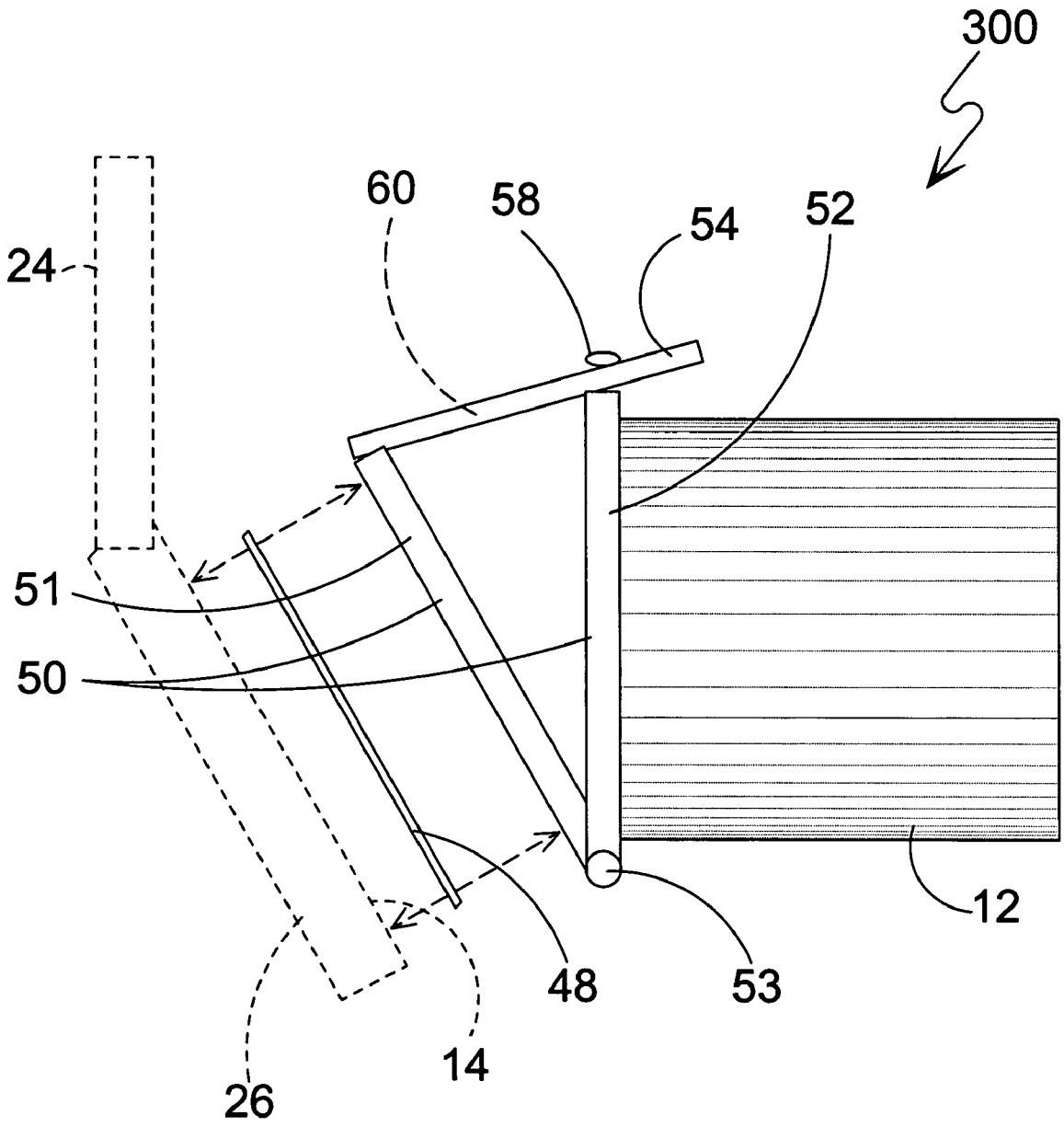
FIG. 20 is a side view of another golf club face mounted version of the present invention.

Turning to FIG. 20, shown therein is a side view of another additional element of the present invention. Shown is another additional element of the present invention wherein the golf swing training device 300 incorporates a mountable frame 50 having golf club head mountable frame member 51 and cup mounted frame member 52 pivotally fastened together by mounting frame hinge 53 thereby providing means for adjusting the cup angle relative to club face 14. Also shown is one means for attaching the present invention 300 to golf club head 26 using double face tape 48. After attachment of the device 300 to club face 14, a desired angle is set by pivoting cup mounted frame member 52 to a desired angle. Once the desired angle has been determined. Set screw 58 is tightened to fix the angle between golf club head 26 and cup 12.

Figure 21:
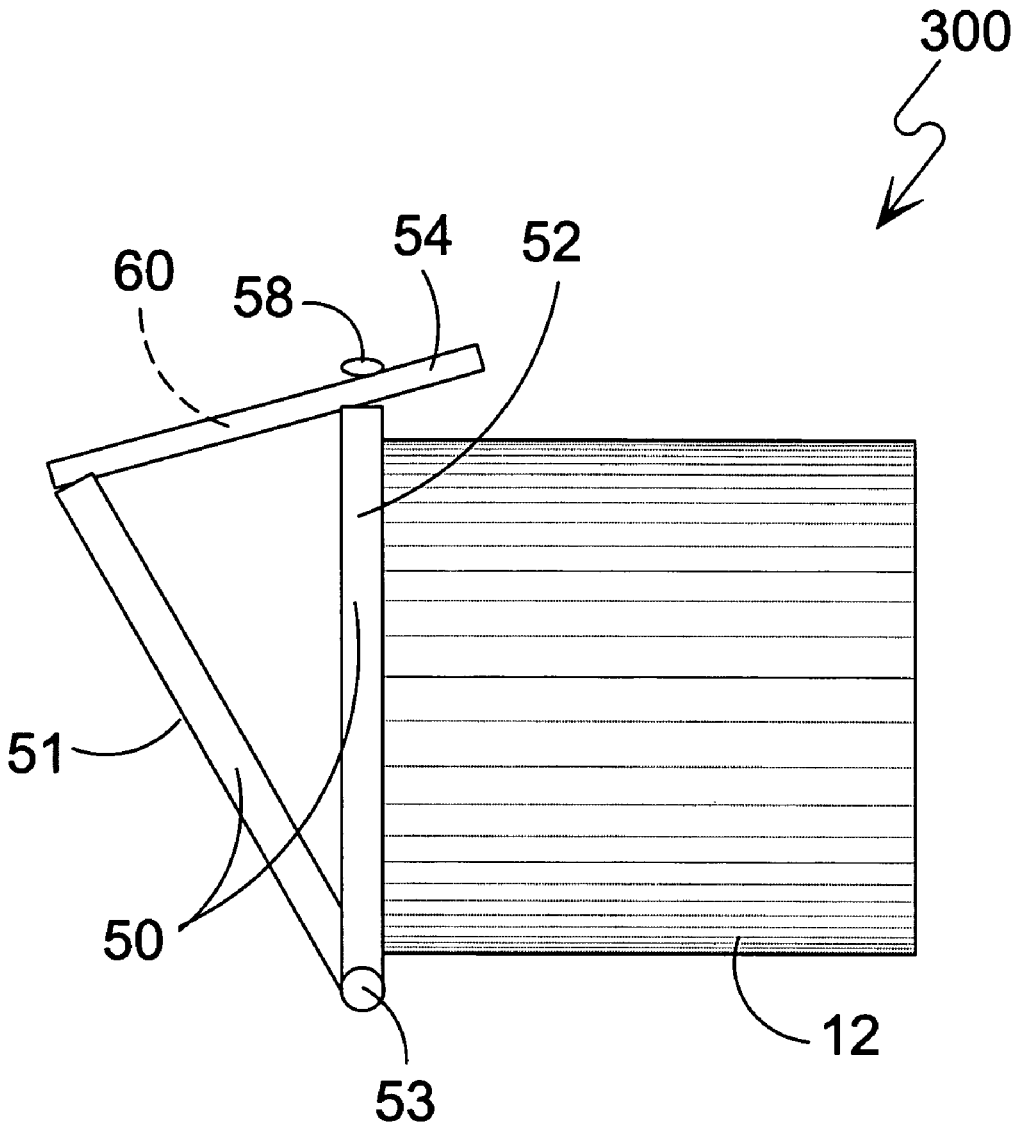
FIG. 21 is a side view of the other golf club face mounted version of the present invention.

Turning to FIG. 21, shown therein is a side view of the additional element depicted in FIG. 20. The present invention 300 provides for another means for attaching the present invention to a golf club head 26. The additional means incorporates mounting frame 50 comprising two planar members 51, 52 pivotally connected by mounting frame hinge 53 with slide stay 54 for fixedly setting a desired angle between the pivotal members. Slide stay 54 is mounted to the top side of head mounted frame member 51 with slide stay 54 having a longitudinal slot 60 with set screw 58, which is threadedly fastened to the top side of cup mounted frame member 52 traveling in slide aperture 60 providing means for fixedly positioning one mounting frame member relative to the other.

Figure 22:
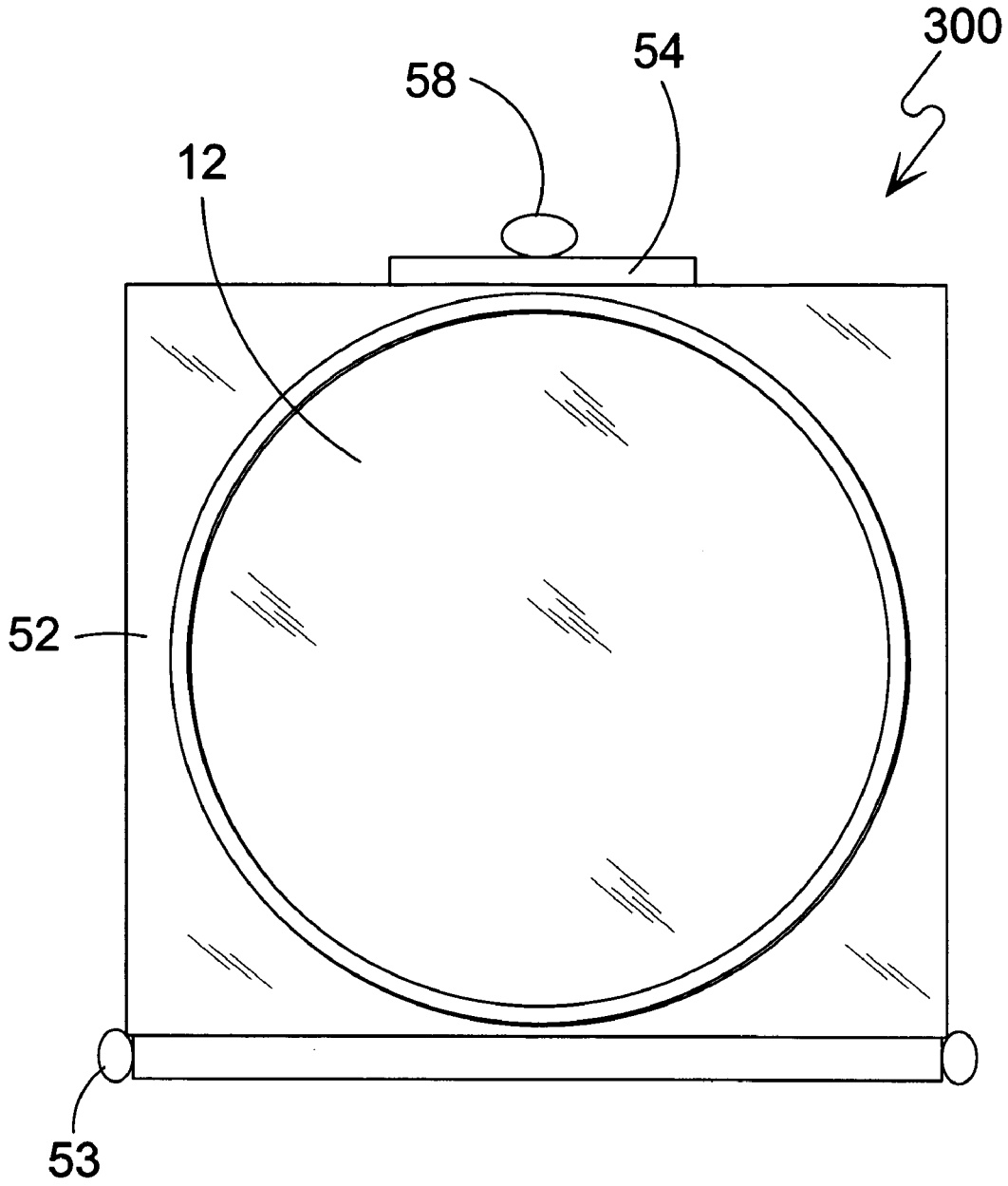
FIG. 22 is a front view of the other golf club face mounted version of the present invention.

Turning to FIG. 22, shown is a front view of the mountable golf swing training device illustrate in FIG. 20. Shown is the present invention 300 comprising mountable frame 50 having golf club head mountable member 51 and cup mounted member 52 having cup 12 mounted thereon. Angular adjustment of cup 12 relative to golf club head 26 is achieved by loosening set screw 58 traveling in slide aperture 60 of slide 54. When the desired angle has been determined, set screw 58 is tightened and the present invention 300 is ready for use.

Figure 23:
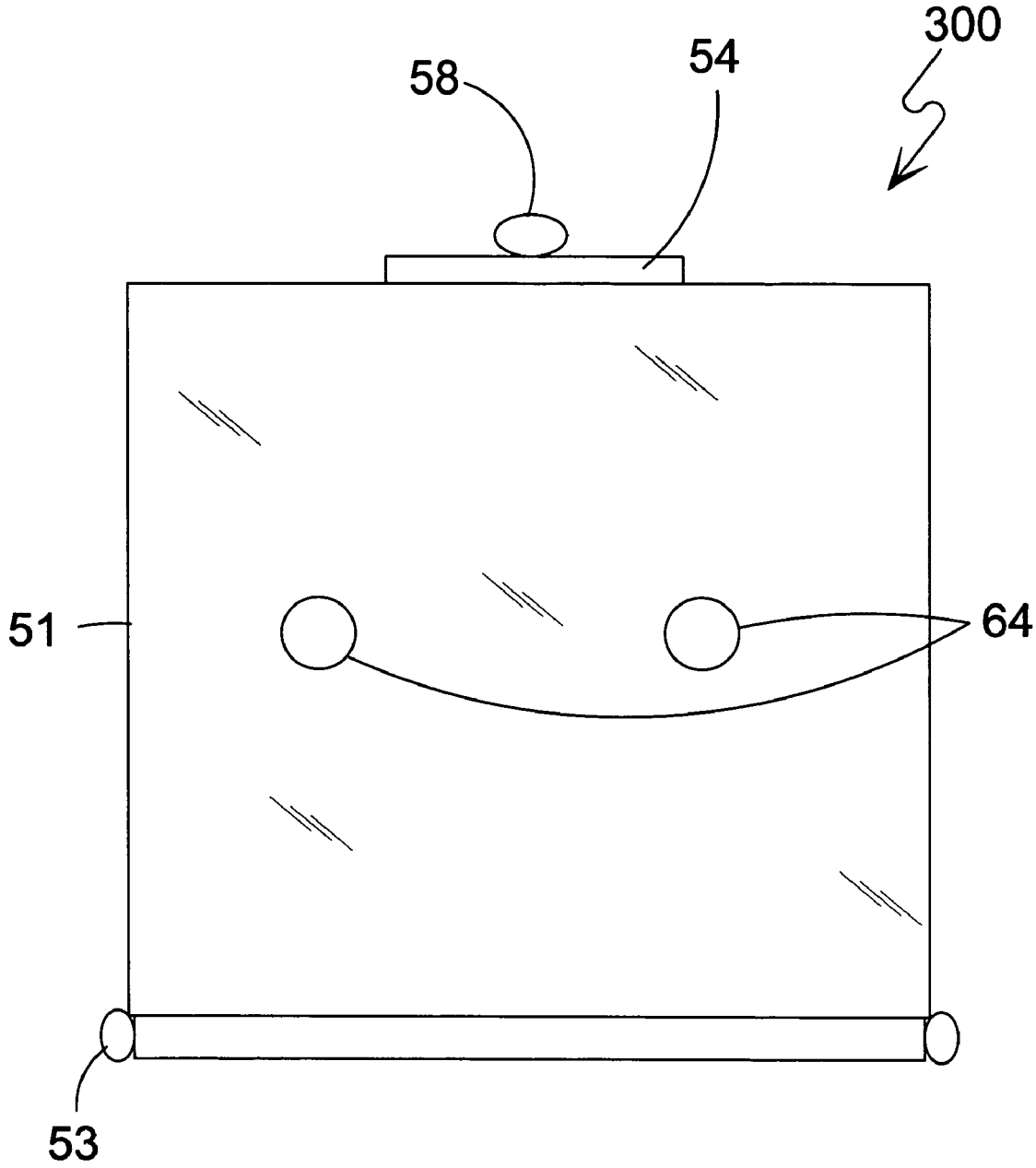
FIG. 23 is a back view of the other golf club face mounted version of the present invention.

Turning to FIG. 23, shown is a back view of the golf club head mountable golf swing training device as shown in FIG. 20. Shown is a back view of the present invention 300 having head mounted frame member 51 that mounts to golf club face 14 of golf club head 26. As previously stated, angular adjustment of cup 12 relative to golf club head 26 is achieved by loosening set screw 58 traveling in slide aperture 60 of slide 54. When the desired angle has been determined, set screw 58 is tightened and the present invention 300 is ready for use. The present invention 300 also provides for additional means for securing the present invention 300 to golf club head 26 by providing frame mounting apertures 64 whereby the present invention can be releasably fixed to golf club head 26 using the appropriated fasteners.

Figure 24:
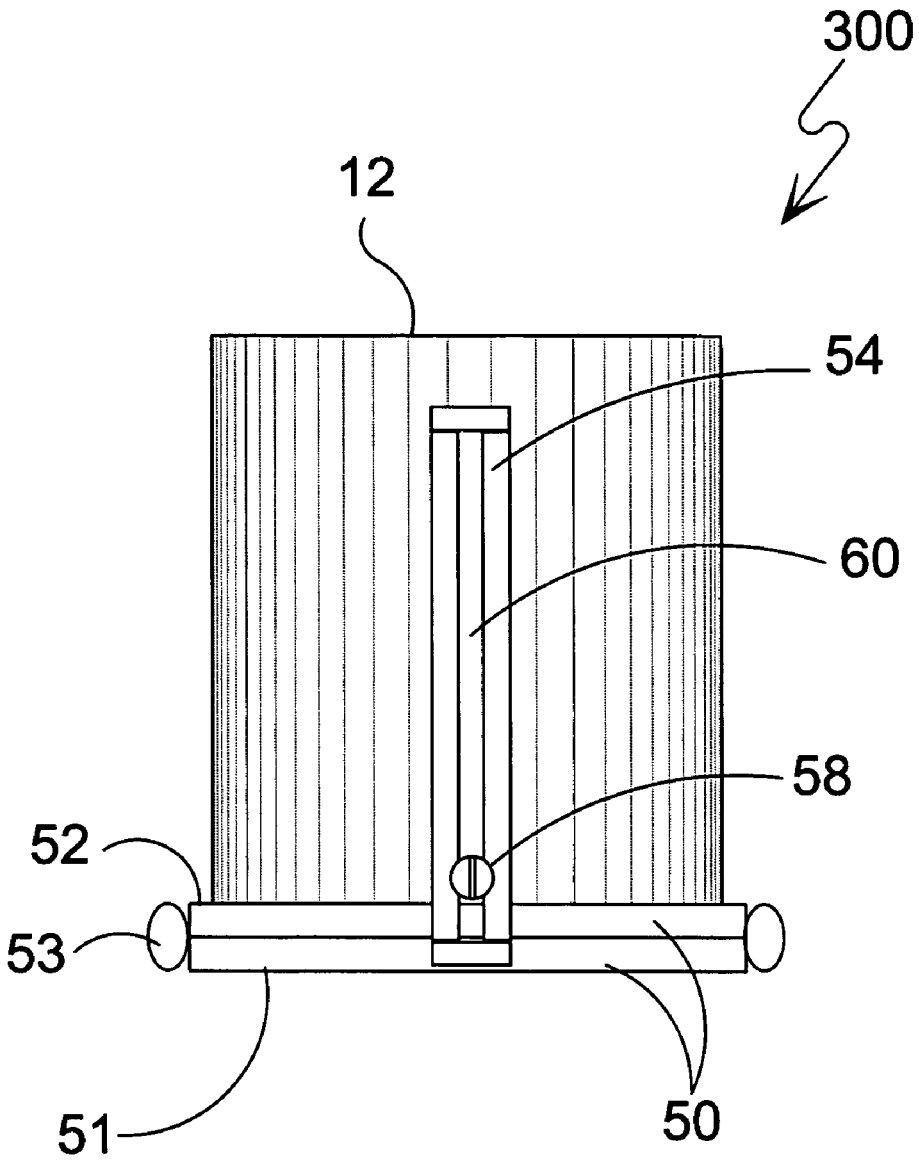
FIG. 24 is a top view of the other golf club face mounted version of the present invention.

Turning to FIG. 24, shown therein is a top view of the golf club head mountable golf swing training device 300 of the present invention. Mounting frame 50 is comprised of pivotally fastened members 51, 52 by means of mounting frame hinge 53. As illustrated, the front pivotal member 52 has cup 12 mounted thereon with set screw 58 located on the top edge of pivotal member 52 traveling in longitudinal slot 60 of slide stay 54. Slide 54 is fastened to the top edge of back mounted frame member 51. Since the front and back frame members 51, 52 are hingedly fastened at the base using mounting frame hinge 53, angular divergence of the front pivotal frame member 52 relative to the back pivotal frame member 51 is therein provided with slide stay 54 and set screw 58 providing means for releasably fixing the desired angular displacement.

Figure 25:
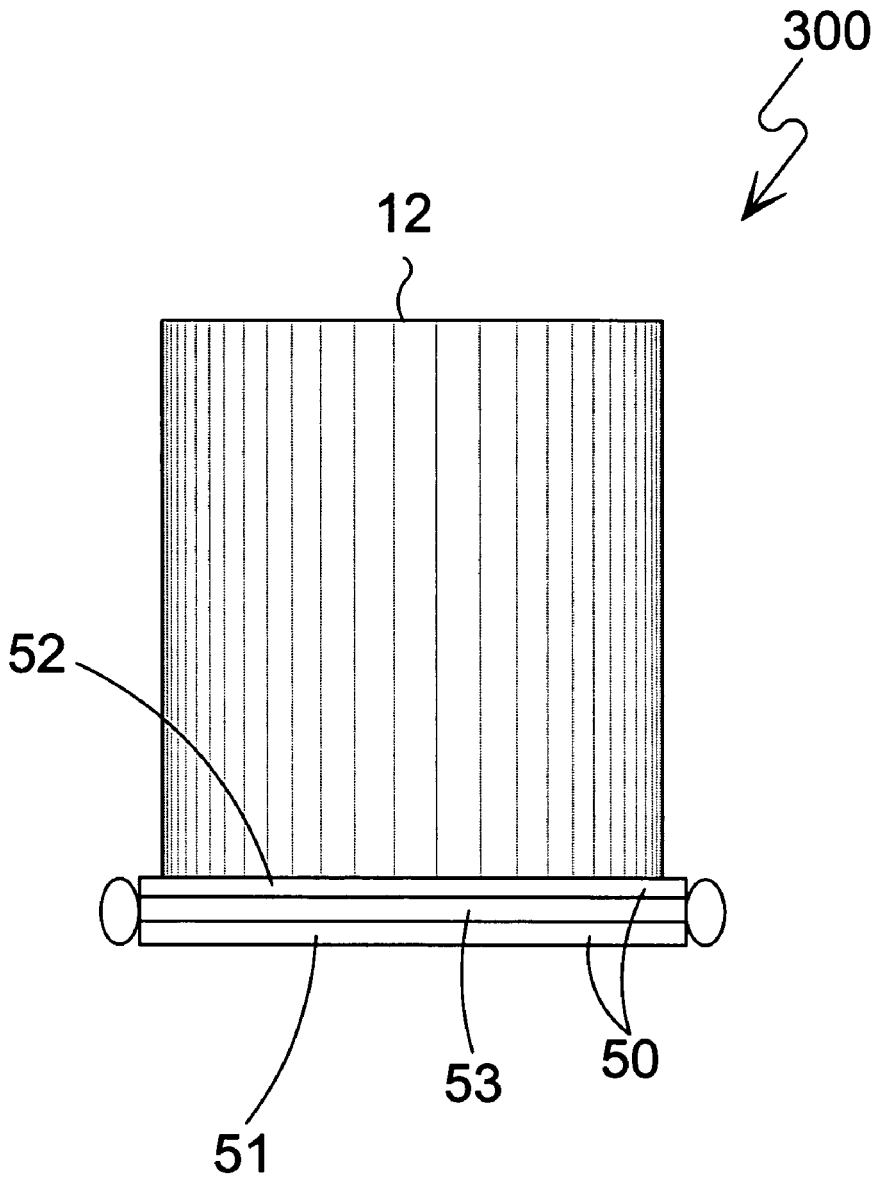
FIG. 25 is a bottom view of the other golf club face mounted version of the present invention.

Turning to FIG. 25, shown therein is a bottom view of the golf club head mountable golf swing training device 300 of the present invention. As previously described mounting frame 50 is comprised of pivotally fastened members 51, 52 by means of mounting frame hinge 53. Since the front and back frame members 51, 52 are hingedly fastened at the base using mounting frame hinge 53, angular divergence of the front pivotal frame member 52 relative to the back pivotal frame member 51 is therein provided with slide stay 54 and set screw 58 providing means for releasably fixing the desired angular displacement.

Figure 26:
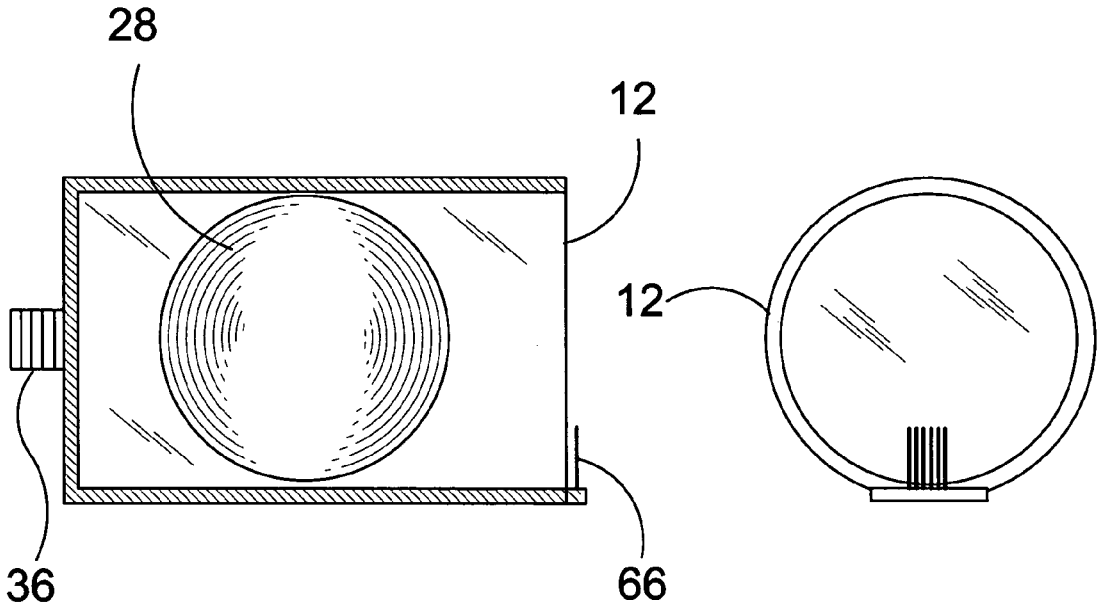
FIG. 26 is another type of restrainer comprising bristle mounted on cup lip.

Turning to FIG. 26, shown therein is a side view of an additional element of the present invention. Shown is an additional element of the present invention wherein the cup 12 is removably fastened to the club face 14. The cup 12 has a male threaded member 36 and the club head 14 has a female threaded bore 38. The cup 12 may incorporate a partially circumferentially positioned plurality of cup mounted bristles 66 to retard the ball from easily falling out of the cup and frustrating the novice golfer.

Figure 27:
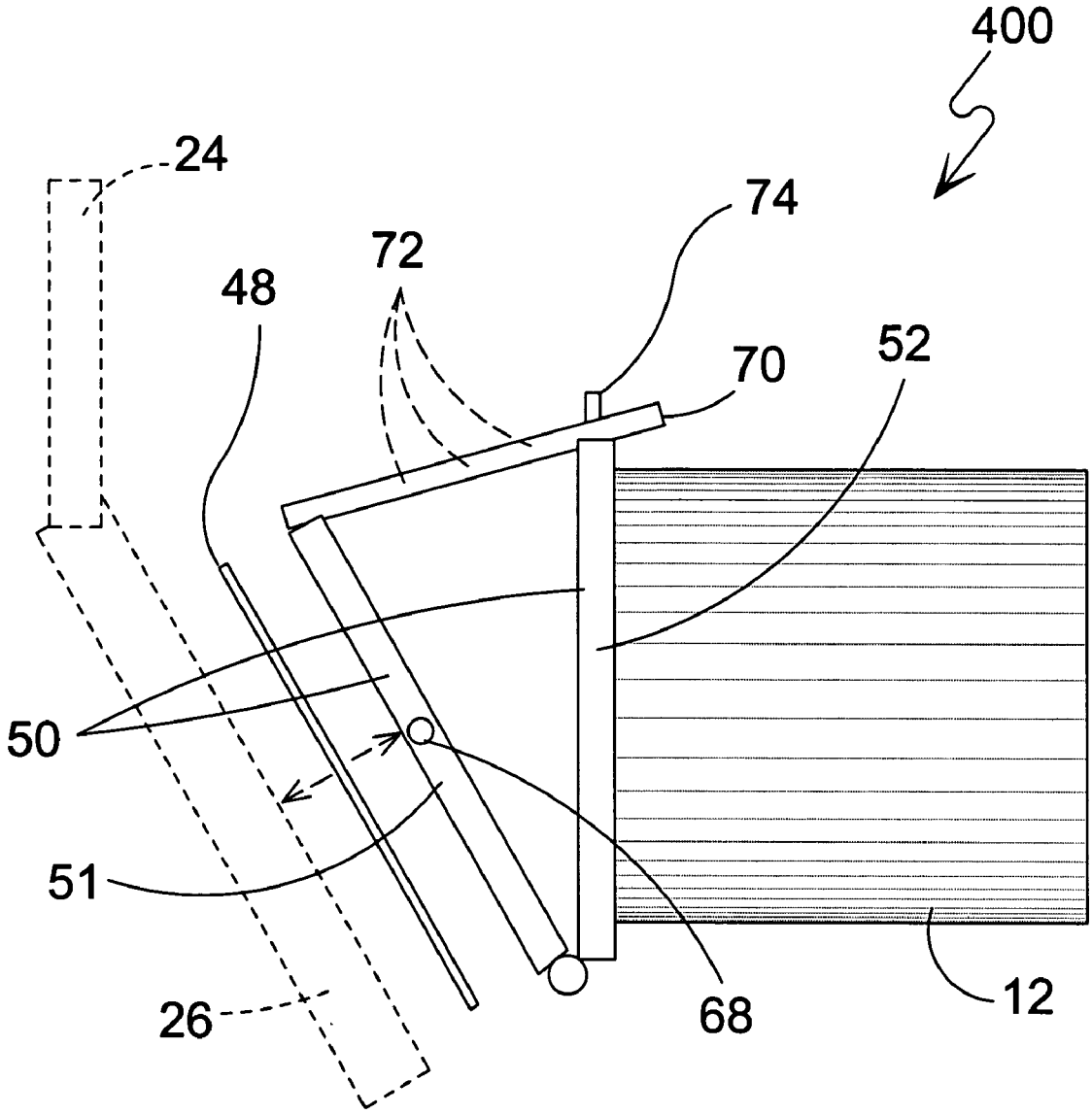
FIG. 27 is a side view of an alternate golf club face mounted version of the present invention.

Turning to FIG. 27, shown therein is a side view of another additional element of the present invention. Shown is another additional element 400 of the present invention wherein the golf swing training device 400 incorporates a mountable frame 50 having pivotal members that provide means for adjusting the cup angle relative to the mounted surface, which in this case is club face 14. Once the desired angle has been determined, adjuster strap 70 having a plurality of adjuster strap apertures 72 is snapped onto the adjuster strap post 74 at the appropriate aperture 72 that will maintain the desired angular displacement.

Figure 28:
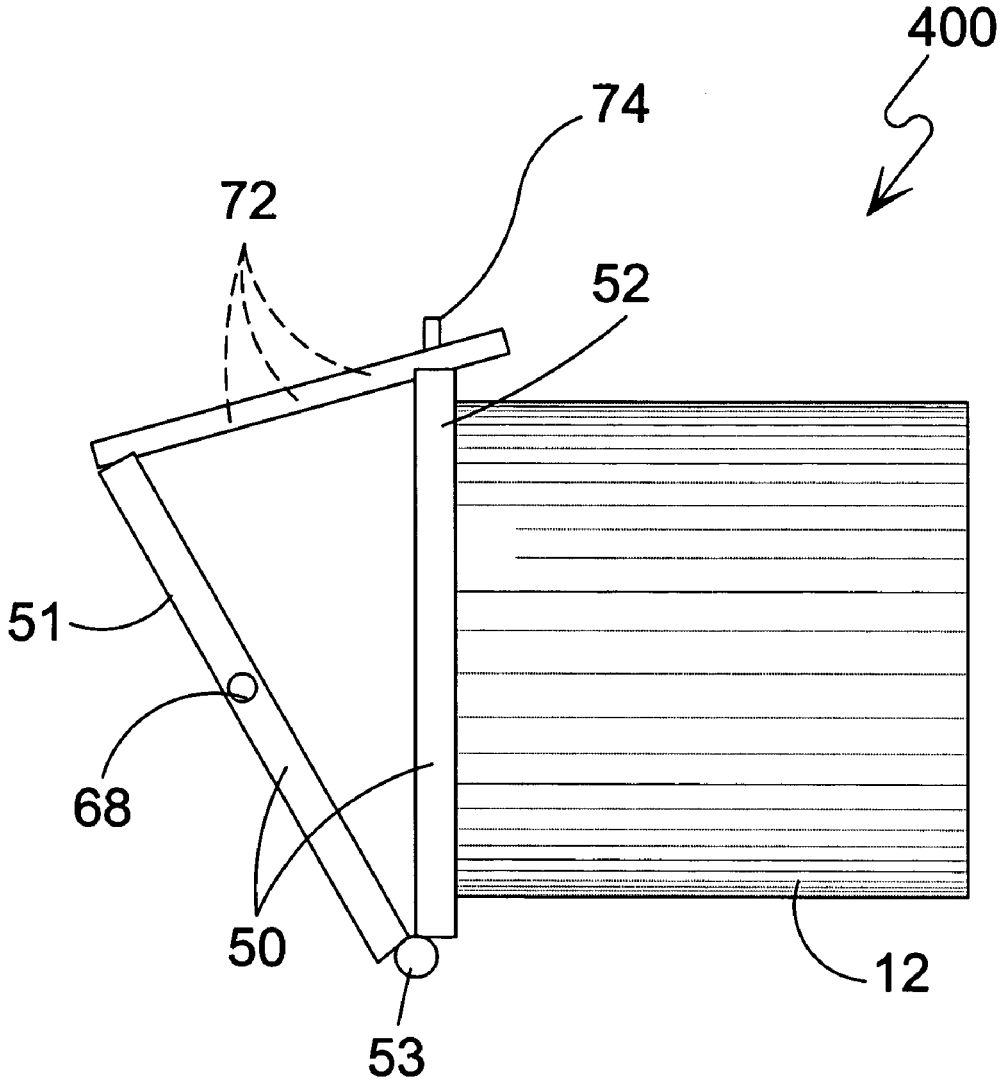
FIG. 28 is a side view of the alternate golf club face mounted version of the present invention.

Turning to FIG. 28, shown therein is a side view of the additional element as shown in FIG. 27. The present invention 400 provides for another means for attaching the present invention to a golf club head 26. The additional means incorporates a mounting frame 50 comprising head mounted frame member 51 and cup mounted frame member 52 connected by mounting frame hinge 53 with adjuster strap 70 providing means for fixedly setting a desired angle between the pivotal members 51, 52. Adjuster strap 70 is fastened to the top edge of frame member 51 with an adjuster strap post extending from the top edge of frame member 52. Adjuster strap 70 has a plurality of spaced apart apertures 72. In operation, the present invention 400 is fastened to a golf club face 14 of golf club head 26 whereupon the user positions cup mounted frame member 52 to a desired angle relative to the head mounted frame member 51. When the desired angle is determined, the selected adjuster strap aperture 72 of adjuster strap 70 is pressed onto adjuster strap post 74 fixing the desired angle until selectively changed.

Figure 29:
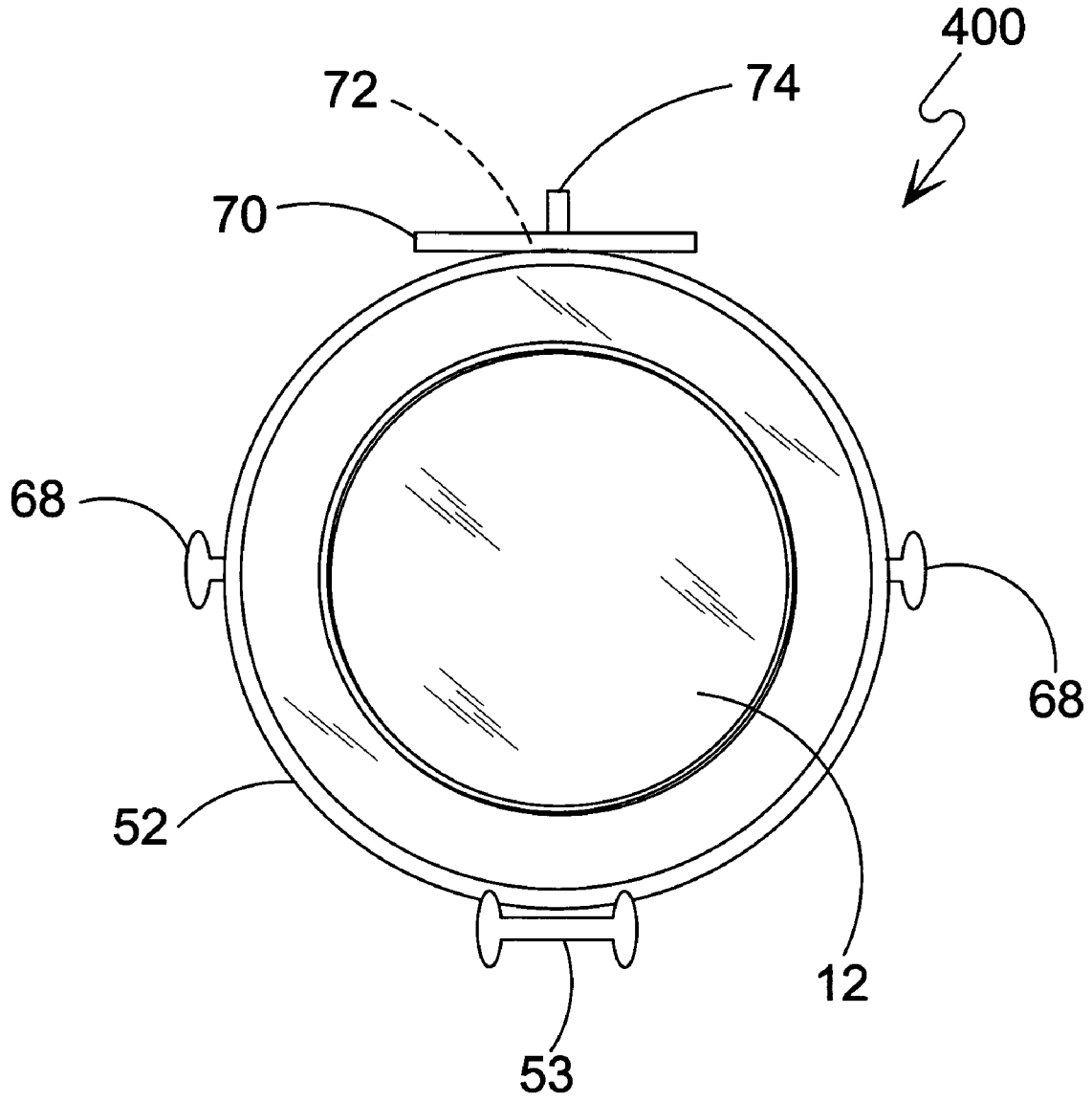
FIG. 29 is a front view of the alternate golf club face mounted version of the present invention.

Turning to FIG. 29, shown is a front view of the mountable golf swing training device as depicted in FIG. 27. Shown is the present invention 400 comprising mountable frame 50 having cup 12 mounted thereon. Angular adjustment of cup 12 relative to golf club head 26 is achieved by selecting an adjuster strap aperture 72 and pressing the aperture 72 onto adjuster strap post 74. The present invention 400 also provides for additional means for securing the present invention 400 to golf club head 26 by incorporating a safety strap (not shown) and safety strap anchors 68 positioned on opposing sides of head mounted frame member 51. The safety strap is fixed to one of the safety strap anchors 68 and extended across the back of golf club head 26 and fastened to the opposing safety strap anchor 68 thereby providing an additional means of mounting the present invention 400 to golf club head 26.

Figure 30:
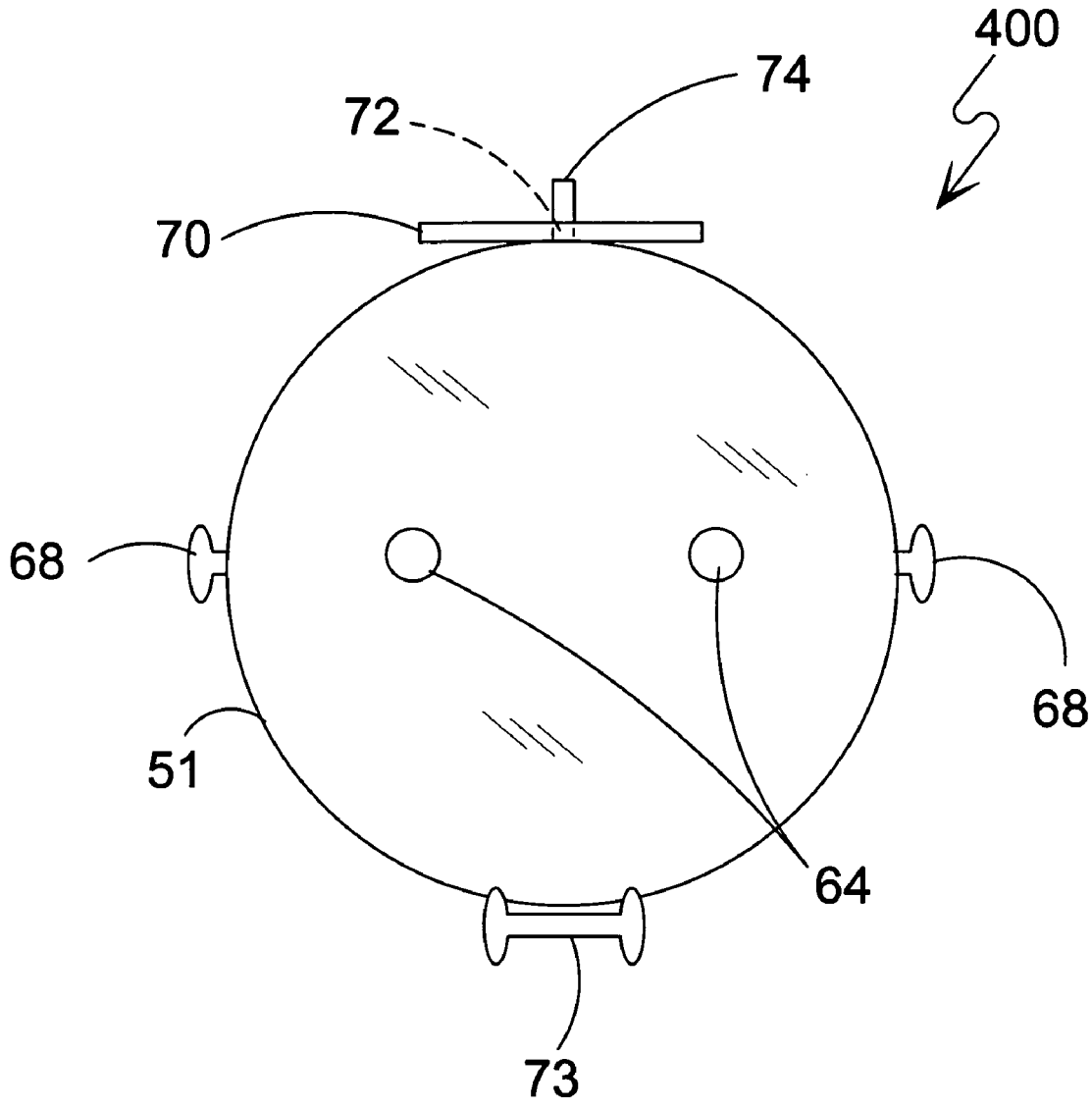
FIG. 30 is a back view of the alternate golf club face mounted version of the present invention.

Turning to FIG. 30, shown is a back view of the golf club head mountable golf swing training device illustrated in FIG. 27. Shown is a back view of the present invention 400 having head mounted frame member 51 that mounts to golf club face 14 of golf club head 26. As previously stated for this additional element, angular adjustment of cup 12 relative to golf club head 26 is achieved by determining a desired angular displacement, noting the appropriate adjuster strap aperture and pushing said aperture 72 onto adjuster strap post 74. The present invention 400 also provides for additional means for securing the present invention 400 to golf club head 26 by incorporating safety strap anchors 68 positioned on opposing sides of head mounted frame member 51 providing means for attachment of a safety strap (not shown). Additionally, the present invention provides frame mounting apertures 64 whereby the present invention can be releasably fixed to golf club head 26 using appropriate fasteners.

Figure 31:
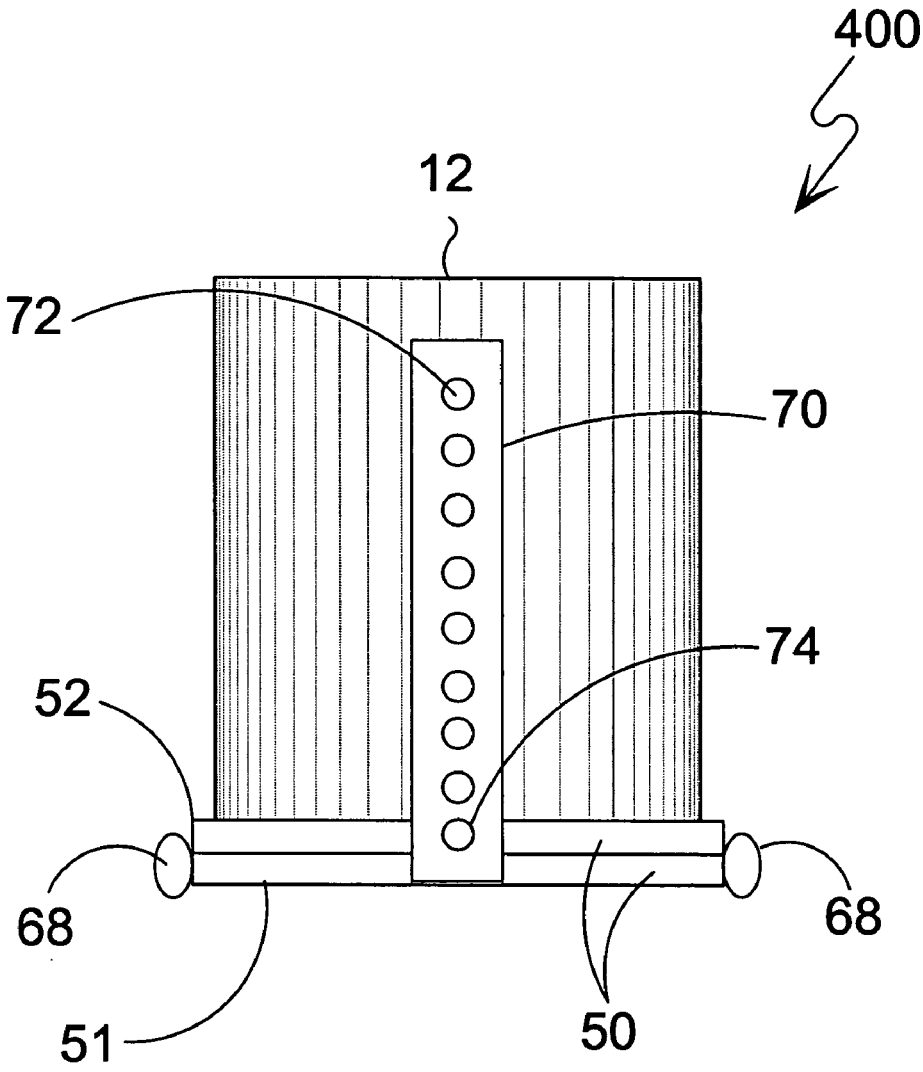
FIG. 31 is a top view of the alternate golf club face mounted version of the present invention.

Turning to FIG. 31, shown therein is a top view of the golf club head mountable golf swing training device 400 of the present invention. Mounting frame 50 is comprised of pivotally fastened frame members 51, 52. As illustrated, the front pivotal member 52 has cup 12 depending therefrom with adjuster strap post 74 extending from frame member 52. Adjuster strap 70 having a plurality of spaced apart apertures is fastened to the back pivotal frame member 51. Since the front and back frame members 51, 52 are hingedly fastened at the base using mounting frame hinge 53, angular divergence of the front pivotal frame member 52 relative to the back pivotal frame member 51 is therein provided with adjuster strap 70 and adjuster strap post 74 providing means for releasably fixing the desired angular displacement.

Figure 32:
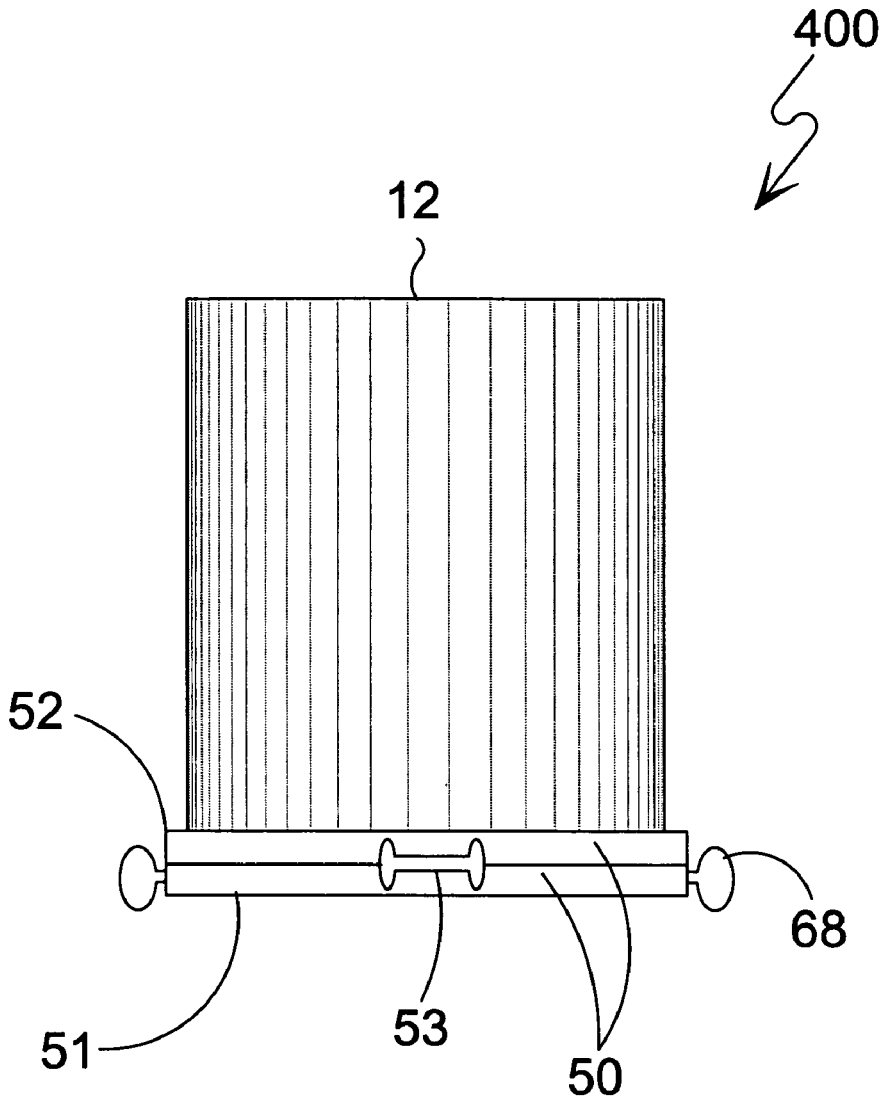
FIG. 32 is a bottom view of the alternate golf club face mounted version of the present invention.

Turning to FIG. 32, shown therein is a bottom view of the golf club head mountable golf swing training device 400 of the present invention. As previously described mounting frame 50 is comprised of pivotally fastened members 51, 52 by means of mounting frame hinge 53. Since the front and back frame members 51, 52 are hingedly fastened at the base via mounting frame hinge 53, angular divergence of the front pivotal frame member 52 relative to the back pivotal frame member 51 is therein provided with adjuster strap 70 and adjuster strap post 74 providing means for releasably fixing the desired angular displacement. Also, the present invention provides an additional means for securing the present invention 400 to golf club head 26 by incorporating safety strap anchors 68 positioned on opposing sides of head mounted frame member 51 providing means for attachment of a safety strap (not shown).

The invention claimed is:

1. An apparatus for a golf swing training device, comprising:

(a) a golf club having a shaft, a grip, a club head and a club face;

(b) a cup being disposed on said face of said golf club, wherein said cup is cylindrically shaped having a front and rear end and a top side, wherein said rear end is attached to said club face, wherein said front end is open to permit a golf ball to be placed in the cup to train a user how to properly swing the golf club;

(c) a marker being disposed on said top side of said cup so that a user can aim the marker toward the target of a golf ball; and a ridge being disposed on the inside of said cup adjacent said front end so as to retain a golf ball inside said cup, wherein said cup is said to receive a conventional golf ball therein and said apparatus has an arrow.

2. The apparatus of claim 1, wherein said cup is removably attached to said club face.

3. The apparatus of claim 2, further comprising a male threaded member being disposed on said rear end of said cup for removable attachment to a mating female threaded member being disposed on said club face.

4. An apparatus for a golf swing training device, comprising:

(a) a golf club having a shaft, a grip, a club head and a club face;

(b) a cup being disposed on said face of said golf club, wherein said cup is cylindrically shaped having a front and rear end and a top side, wherein said rear end is attached to said club face, wherein said front end is open to permit a golf ball to be placed in the cup to train a user how to properly swing the golf club;

(c) a first ribbon for placement on the ground in front of the toes of the feet of a user so as to mark the location where a user should stand relative to a golf ball; and, (d) a second ribbon for placement on the ground in front of said front end of said cup, wherein said second ribbon is parallel to the center line of said cup so as to provide a target line to a target;

(e) a marker being disposed on said top side of said clip so that a user can aim the marker toward the target of a golf ball; and a ridge being disposed on the inside of said cup adjacent said front end so as to retain a golf ball inside said cup, wherein said cup is sized to receive a conventional golf ball therein and said apparatus has an arrow.

5. The apparatus of claim 4, wherein said cup is removably attached to said club face.

6. The apparatus of claim 5, further comprising a male threaded member being disposed on said rear end of said cup for removable attachment to a mating female threaded member being disposed on said club face.

7. The apparatus of claim 6, wherein said first ribbon is shorter than said second ribbon.

8. The apparatus of claim 7, further comprising a portable target for placement on a support surface to permit a golfer to have a target with which to practice a golf swing.

* * * * *